US009498969B2

(12) United States Patent
Kobayashi

(10) Patent No.: US 9,498,969 B2
(45) **Date of Patent: *Nov. 22, 2016**

(54) LIQUID CARTRIDGE

(71) Applicant: BROTHER KOGYO KABUSHIKI KAISHA, Nagoya-shi, Aichi-ken (JP)

(72) Inventor: Tetsuro Kobayashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/520,443

(22) Filed: Oct. 22, 2014

(65) Prior Publication Data

US 2016/0059570 A1 Mar. 3, 2016

(30) Foreign Application Priority Data

Aug. 29, 2014 (EP) ..... 14182931

(51) Int. Cl.
*B41J 2/175* (2006.01)

(52) U.S. Cl.
CPC ..... *B41J 2/17523* (2013.01); *B41J 2/17513* (2013.01)

(58) Field of Classification Search
CPC ..... B41J 2/17523; B41J 2/17513
See application file for complete search history.

(56) References Cited

U.S. PATENT DOCUMENTS 4,862,192 A 8/1989 Slomianny
9,150,011 B1 10/2015 Tomoguchi et al.
2003/0128256 A1 7/2003 Oda et al.
2005/0146579 A1 7/2005 Sasaki et al.
2006/0290753 A1 12/2006 Tatsumi et al.
2007/0236549 A1 10/2007 Yamada
2008/0239033 A1 10/2008 Hattori
2009/0141095 A1* 6/2009 Umeda ..... B41J 2/16523 347/85
2010/0238241 A1 9/2010 Sasaki
2010/0245458 A1 9/2010 Nakamura
2010/0289856 A1* 11/2010 Yamamoto ..... B41J 2/17513 347/85
2012/0056954 A1 3/2012 Asauchi et al.
2012/0182365 A1 7/2012 Ma
2015/0298461 A1 10/2015 Koganehira et al.
2016/0059571 A1 3/2016 Kobayashi
2016/0059572 A1 3/2016 Kobayashi

FOREIGN PATENT DOCUMENTS

DE 20 2008 018 473 U1 4/2014
EP 0282049 A2 9/1988
EP 0803364 A2 10/1997

(Continued)

OTHER PUBLICATIONS

Extended European Search Report issued in EP 14182935.8, mailed Feb. 12, 2015.

(Continued)

*Primary Examiner* — Justin Seo
(74) *Attorney, Agent, or Firm* — Merchant & Gould P.C.

(57) ABSTRACT

A liquid cartridge includes a first liquid chamber, a second liquid chamber, a communication path through which liquid can flow from the first liquid chamber to the second liquid chamber, a blocking member configured to block communication between the first liquid chamber and the second liquid chamber through the communication path, and a movable member positioned in the second liquid chamber and comprising a detection portion and a float.

24 Claims, 16 Drawing Sheets

(56) References Cited

FOREIGN PATENT DOCUMENTS

| | | | |
|---|---|---|---|
| EP | 1570995 | A1 | 9/2005 |
| EP | 2039520 | A1 | 3/2009 |
| EP | 2 174 788 | A1 | 4/2010 |
| EP | 2 708 362 | | 3/2014 |
| JP | 8-281966 | A | 10/1996 |
| JP | 9-277560 | A | 10/1997 |
| JP | 2008-254194 | A | 10/2008 |
| WO | 2009/066612 | A1 | 5/2009 |

OTHER PUBLICATIONS

Extended European Search Report issued in EP 14182931.7, mailed Feb. 12, 2015.
Extended European Search Report issued in EP 14182929.1, mailed Feb. 12, 2015.
U.S. Office Action issued in related U.S. Appl. No. 14/520,468, mailed Feb. 2, 2016.
U.S. Office Action issued in related U.S. Appl. No. 14/520,491, mailed Oct. 29, 2015.
Office Action from German Patent Application No. 10 2015 203 327.9, issued Feb. 12, 2016.
Office Action from German Patent Application No. 10 2015 203 328.7, issued Feb. 12, 2016.
Office Action from German Patent Application No. 10 2015 203 330.9, issued Feb. 12, 2016.
U.S. Notice of Allowance issued in related U.S. Appl. No. 14/520,491, mailed Feb. 29, 2016.
U.S. Office Action (Notice of Allowance) issued in related U.S. Appl. No. 14/520,491, May 2, 2016.
U.S. Office Action (Notice of Allowance) issued in related U.S. Appl. No. 14/520,468, Jul. 1, 2016.
Office Action issued in related Chinese patent application No. 201510089200.3, dated Aug. 1, 2016.

* cited by examiner

LIQUID CARTRIDGE

CROSS-REFERENCE TO RELATED APPLICATION

The present application claims priority to and the benefit of European Patent Application No. 14182931.7, which was filed on Aug. 29, 2014, the disclosure of which is incorporated herein by reference in its entirety.

BACKGROUND OF THE INVENTION

1. Field of the Invention

The present invention relates to a liquid cartridge.

2. Description of Related Art

A known ink-jet recording apparatus is configured to record an image on a recording medium by ejecting ink stored in an ink container from nozzles. The viscosity of ink stored in the ink container may change over time. A known ink-jet recording apparatus, as described in Patent Application Publication No. JP-09-277560 A, is configured to estimate the viscosity of ink stored in an ink container, and perform optimized preliminary ejection based on the result of the estimation. More specifically, the ink-jet recording apparatus is configured to estimate the viscosity of ink based on an elapsed time since the ink container is mounted to the ink-jet recording apparatus and an amount of ink remaining in the ink container. Nevertheless, this known ink-jet recording apparatus does not estimate the viscosity by directly measuring a physical quantity obtained when ink moves in the ink container. Moreover, this known ink-jet recording apparatus cannot estimate the viscosity of ink stored in an ink container which has not been mounted to the ink-jet recording apparatus and been unused.

SUMMARY OF THE INVENTION

Therefore, a need has arisen for a liquid cartridge which overcomes these and other shortcomings of the related art. A technical advantage of the present invention is that the viscosity of liquid stored in a liquid cartridge may be estimated by more direct measurement.

According to an aspect of the present invention, a liquid cartridge comprises a liquid chamber configured to store liquid therein, wherein the liquid has a first specific gravity; a liquid supply portion configured to supply the liquid from an interior of the liquid chamber to an exterior of the liquid chamber; a partitioning wall partitioning the liquid chamber into a first liquid chamber and a second liquid chamber, a communication path through which the liquid can flow from the first liquid chamber to the second liquid chamber; a blocking member configured to block communication between the first liquid chamber and the second liquid chamber through the communication path, such that the liquid is prevented from flowing from the first liquid chamber to the second liquid chamber through the communication path; and a first movable member positioned in the second liquid chamber and comprising a detection portion and a float, wherein the float has a second specific gravity which is less than the first specific gravity.

With this configuration, when the blockage of the communication between the first liquid chamber and the second liquid chamber by the blocking member is released, the liquid moves from the first liquid chamber to the second liquid chamber through the communication path. The flow rate of the liquid moving from the first liquid chamber to the second liquid chamber varies depending on the viscosity of liquid in the liquid chamber, and the velocity of the first movable member which moves as the liquid surface in the second liquid chamber moves up varies depending on the flow rate of the liquid. Therefore, by measuring a time required for the detection portion to move a certain distance, the viscosity of liquid stored in the liquid chamber may be estimated.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-16B, like numerals being used for like corresponding parts in the various drawings.

[Printer 10]

Figure 1:
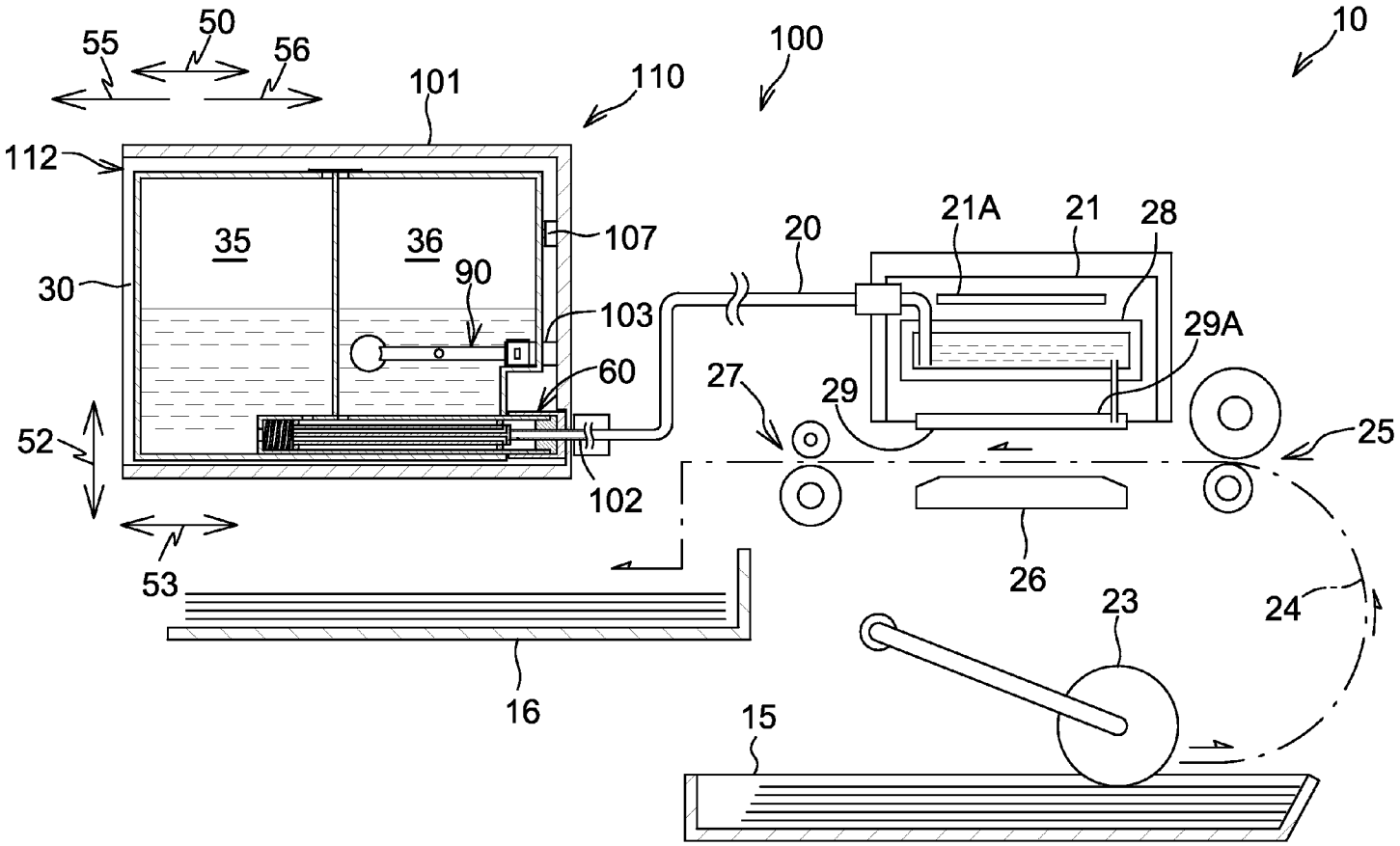
FIG. 1 is a schematic, cross-sectional view of a printer comprising a cartridge mounting portion and an ink cartridge, according to an embodiment of the present invention.

Referring to FIG. 1, a liquid consuming apparatus, e.g., a printer 10 is an inkjet printer configured to record an image on a sheet of recording paper by ejecting ink droplets selectively on the sheet of recording paper. The printer 10 comprises a liquid consuming portion, e.g., a recording head 21, an ink supply device 100, and an ink tube 20 connecting the recording head 21 and the ink supply device 100. The ink supply device 100 comprises a cartridge mounting portion 110. The cartridge mounting portion 110 is configured to allow a liquid container or a liquid cartridge, e.g., an ink cartridge 30 to be mounted therein. The cartridge mounting portion 110 has an opening 112 and the interior of the cartridge mounting portion 110 is exposed to the exterior of the cartridge mounting portion 110 via opening 112. The ink cartridge 30 is configured to be inserted into the cartridge mounting portion 110 via the opening 112 in an insertion direction 56, and to be removed from the cartridge mounting portion 110 via the opening 112 in a removal direction 55.

The ink cartridge 30 is configured to store ink, which is used by the printer 10. The ink cartridge 30 and the recording head 21 are fluidically connected via the ink tube 20 when mounting of the ink cartridge 30 to the cartridge mounting portion 110 has been completed. The recording head 21 comprises a sub tank 28. The sub tank 28 is configured to temporarily store ink supplied via the ink tube 20 from the ink cartridge 30. The recording head 21 comprises nozzles 29 and is configured to selectively eject ink supplied from the sub tank 28 through the nozzles 29. More specifically, the recording head 21 comprises a head control board 21A and piezoelectric actuators 29A corresponding to the nozzles 29, and the head control board 21A is configured to selectively apply driving voltage to the piezoelectric actuators 29A. As such, ink is ejected from the nozzles 29.

The printer 10 comprises a paper feed tray 15, a paper feed roller 23, a conveying roller pair 25, a platen 26, a discharge roller pair 27, and a discharge tray 16. A conveying path 24 is formed from the paper feed tray 15 up to the discharge tray 16 via the conveying roller pair 25, the platen 26, and the discharge roller pair 27. The paper feed roller 23 is configured to feed a sheet of recording paper from the paper feed tray 15 to the conveying path 24. The conveying roller pair 25 is configured to convey the sheet of recording paper fed from the paper feed tray 15 onto the platen 26. The recording head 21 is configured to selectively eject ink onto the sheet of recording paper passing over the platen 26. Accordingly, an image is recorded on the sheet of recording paper. The sheet of recording paper having passed over the platen 26 is discharged by the discharge roller pair 27 to the paper discharge tray 16 disposed at the most downstream side of the conveying path 24.

[Ink Supply Device 100]

Figure 2:
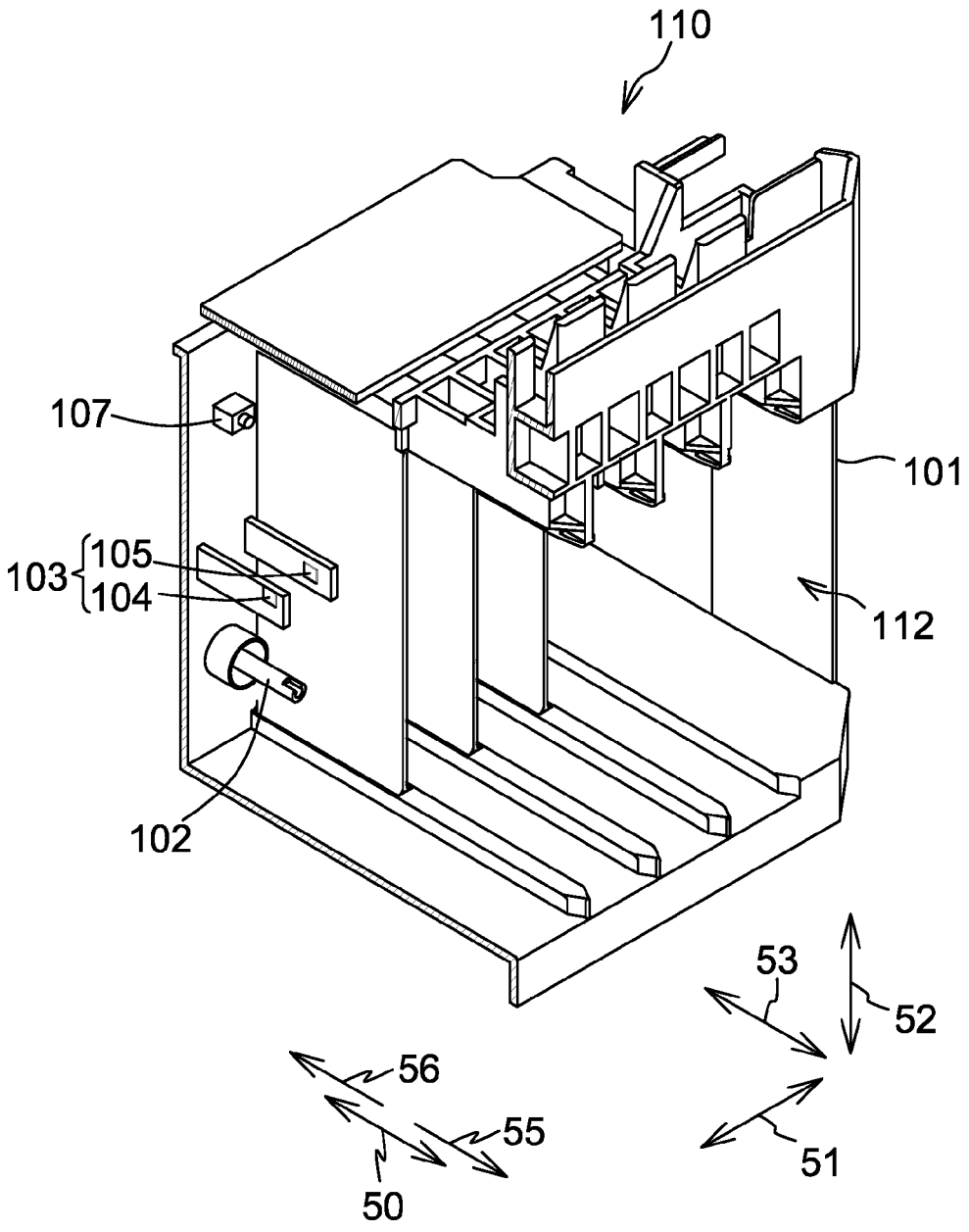
FIG. 2 is a perspective view of the cartridge mounting portion which is partly cut, showing an end surface of the cartridge mounting portion.

Referring to FIG. 1, the printer 10 comprises the ink supply device 100. The ink supply device 100 is configured to supply ink to the recording head 21. The ink supply device 100 comprises the cartridge mounting portion 110 to which the ink cartridge 30 is mountable. The cartridge mounting portion 110 comprises a case 101, a longitudinal object, e.g., a hollow tube 102, a detector, e.g., a sensor 103, and a mount detector, e.g., a mount sensor 107. In FIG. 1, mounting of the ink cartridge 30 to the cartridge mounting portion 110 has been completed. Referring to FIG. 2, the cartridge mounting portion 110 is configured to receive four ink cartridges 30 storing cyan, magenta, yellow, and black inks, respectively. Four hollow tubes 102, four sensors 103, and four mount sensors 107, are provided at the cartridge mounting portion 110, corresponding to the four ink cartridges 30.

[Hollow Tube 102]

The case 101 of the cartridge mounting portion 110 has the opening 112 formed through one face of the case 101. The case 101 comprises an end surface opposite the opening 112. Referring to FIGS. 1 and 2, the hollow tube 102 extends from the end surface of the case 101 in the removal direction 55. The hollow tube 102 is positioned at the end surface of the case 101 and at a position corresponding to an ink supply portion 60 (described later) of the ink cartridge 30. The hollow tube 102 is a resin tube having a liquid path formed therein. The hollow tube 102 has a proximal end and a distal end. The hollow tube 102 has an opening formed through a distal-end side of the hollow tube 102, and the ink tube 20 is connected to a proximal-end side of the hollow tube 102. The hollow tube 102 is configured to contact and move a portion of the ink cartridge 30 for allowing ink stored in the ink cartridge 30 to flow into the ink tube 20 via the hollow tube 102.

The printer 10 comprises a cover (not shown) configured to selectively cover the opening 112 of the cartridge mounting portion 110 and not cover the opening 112 such that the opening 112 is exposed to the exterior of the printer 10. The cover is supported by the case 101 or by an outer case of the printer 10 such that the cover can be selectively opened and closed. When the cover is opened, the opening 112 is exposed to the exterior of the printer 10. When the cover is opened, a user can insert the ink cartridge 30 into the cartridge mounting portion 110 through the opening 112 and can remove the ink cartridge 30 from the cartridge mounting portion 110 through the opening 112. When the cover is closed, the opening 112 is covered and the ink cartridge 30 cannot be inserted into or removed from the cartridge mounting portion 110.

In this description, when it is described that the ink cartridge 30 is mounted to the cartridge mounting portion 110, it means that at least a portion of the ink cartridge 30 is positioned in the cartridge mounting portion 110, more specifically, positioned in the case 101. Therefore, an ink cartridge 30 which is being inserted into the cartridge mounting portion 110 is also an example of an ink cartridge 30 mounted to the cartridge mounting portion 110. On the other hand, when it is described that the mounting of the ink cartridge 30 to the cartridge mounting portion 110 has been completed, it means that the ink cartridge 30 is in such a state that the printer 10 can perform image recording. For instance, when the ink cartridge 30 is in such a state, ink supply from the ink cartridge 30 to the recording head 21 is at least possible, and preferably the ink cartridge 30 is locked such that the movement of ink cartridge 30 relative to the cartridge mounting portion 110 is restricted or the ink cartridge 30 is positioned in the cartridge mounting portion 110 with the cover closed.

[Sensor 103]

Referring to FIG. 2, the sensor 103 is positioned above the hollow tube 102 and extends from the end surface of the case 101 in the removal direction 55. The sensor 103 comprises a light emitting portion, e.g., a light emitting diode, 104 and a light receiving portion, a phototransister, 105 aligned in a width direction 51. The light emitting portion 104 and the light receiving portion 105 face each other in the width direction 51. The light emitting portion 104 is configured to emit light, e.g., visible, infrared, and/or ultraviolet light, toward the light receiving portion 105, and the light receiving portion 105 is configured to receive the light emitted by the light emitting portion 104. In this embodiment, the light emitted by the light emitting portion 104 can pass through ink stored in the ink cartridge 30 and walls of the ink cartridge 30. When the mounting of the ink cartridge 30 to the cartridge mounting portion 110 has been completed, the ink cartridge 30 is positioned between the light emitting portion 104 and the light receiving portion 105. In other words, the light emitting portion 104 and the light receiving portion 105 are provided so as to face each other with the ink cartridge 30 positioned therebetween when the mounting of the ink cartridge 30 to the cartridge mounting portion 110 has been completed.

In this embodiment, a detection position is a position within the ink cartridge 30 which intersects an imaginary line extending between the light emitting portion 104 and the light receiving portion 105 when the mounting of the ink cartridge 30 to the cartridge mounting portion 100 has been completed. In other words, the detection position intersects an optical path extending between the light emitting portion 104 and the light receiving portion 105. In other words, the sensor 103 is positioned so as to face the detection position. In this embodiment, the sensor 103 is positioned so as to face the ink cartridge 30 when the mounting of the ink cartridge 30 to the cartridge mounting portion 110 has been completed. In another embodiment, the sensor 103 is positioned so as to face the ink cartridge 30 when the ink cartridge 30 is being inserted into the cartridge mounting portion 110. That is, the sensor 103 is positioned so as to face the ink cartridge 30 mounted to the cartridge mounting portion 110, and the detection position intersects the optical path extending between the light emitting portion 104 and the light receiving portion 105 when the ink cartridge 30 is mounted to the cartridge mounting portion 110.

The sensor 103 is configured to output different detection signals based on the intensity of light received by the light receiving portion 105. The sensor 103 is configured to output a Low-level signal, i.e., a signal whose level is less than a predetermined threshold value, when the intensity of light received by the light receiving portion 105 is less than a predetermined intensity. The sensor 103 is configured to output a High-level signal, i.e., a signal whose level is greater than or equal to the predetermined threshold value, when the intensity of light received by the light receiving portion 105 is greater than or equal to the predetermined intensity.

[Mount Sensor 107]

Referring to FIGS. 1 and 2, the mount sensor 107 is positioned in a mount detection position in an insertion path of the ink cartridge 30 in the cartridge mounting portion 110. The ink cartridge 30 moves in the insertion path when the ink cartridge 30 is inserted into the cartridge mounting portion 110. In this embodiment, the mount sensor 107 is positioned at the end surface of the case 101. The mount sensor 107 is configured to output different detection signals based on the presence or absence of the ink cartridge 30 in the mount detection position. In this embodiment, the mount sensor 107 is positioned, such that the ink cartridge 30 is positioned in the mount detection position when the mounting of the ink cartridge 30 to the cartridge mounting portion 100 has been completed.

In this embodiment, the mount sensor 107 is a mechanical sensor. When the mount sensor 107 is not pushed by a front wall 40 (described later) of the ink cartridge 30, the mount sensor 107 outputs a Low-level signal, indicating that the ink cartridge 30 is not in the mount detection position. When the mount sensor 107 is pushed by the front wall 40 of the ink cartridge 30, the mount sensor 107 outputs a High-level signal, indicating that the ink cartridge 30 is in the mount detection position. The mount sensor 107 is not limited to the mechanical sensor, but may be an optical sensor such as a combination of a light emitting diode and a phototransistor, a magnetic sensor such as a Hall effect sensor, an electric sensor, or any other known sensor.

[Ink Cartridge 30]

Figure 3B:
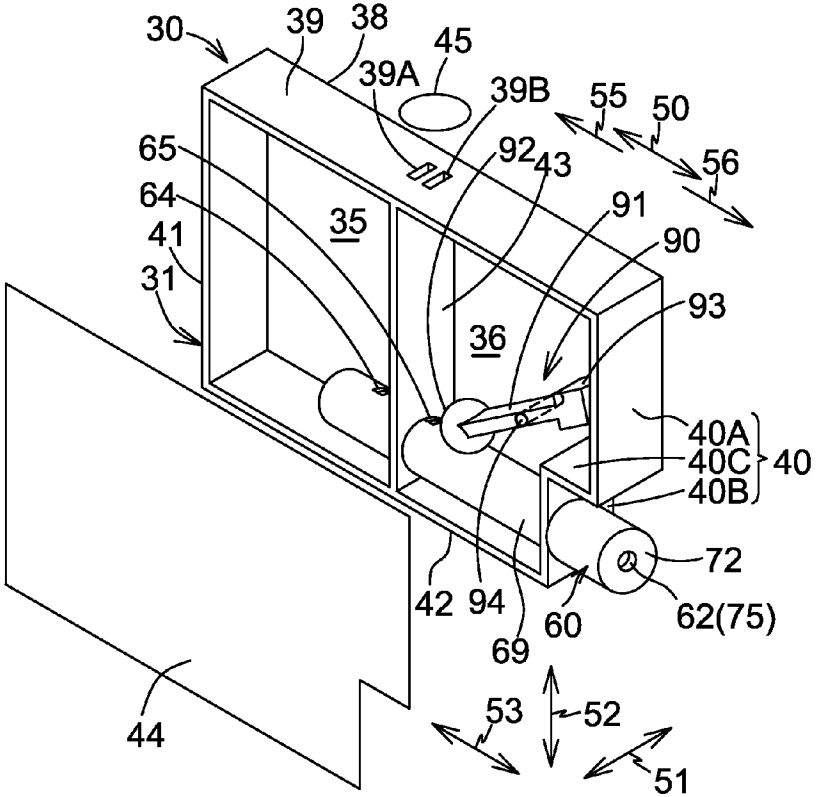
FIG. 3B is an exploded perspective view of the ink cartridge, in which the film is removed from the frame.
Figure 3A:
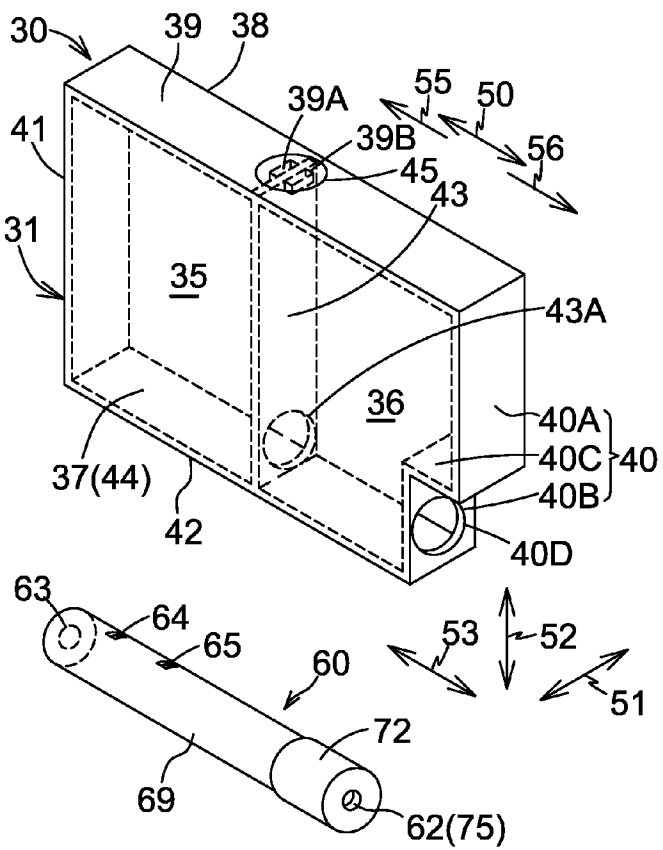
FIG. 3A is a perspective view of the ink cartridge, in which a film is welded to a frame.

Referring to FIGS. 3A and 3B, the ink cartridge 30 comprises a frame 31 having a liquid chamber, e.g., an ink chamber formed therein, and a liquid supply portion, e.g., an ink supply portion 60. The ink chamber is divided into a first ink chamber 35 and a second ink chamber 36. The ink cartridge 30 is configured to supply ink stored in the first ink chamber 35 and the second ink chamber 36 to the exterior of the ink cartridge 30 via the ink supply portion 60. The ink cartridge 30 is configured to be inserted into and removed from the cartridge mounting portion 110 in an insertion-removal direction 50, while the ink cartridge 30 is in an upright position, as shown in FIG. 3A, with a top face of the ink cartridge 30 facing upward and a bottom face of the ink cartridge 30 facing downward. In this embodiment, the insertion-removal direction 50 extends in a horizontal direction. The insertion direction 56 is an example of the insertion-removal direction 50. The removal direction 55 is an example of the insertion-removal direction 50. The insertion direction 56 and the removal direction 55 are opposite directions. In another embodiment, the insertion-removal direction 50 may not extend exactly in a horizontal direction but may extend in a direction intersecting a horizontal direction and the vertical direction.

The frame 31 has substantially a rectangular parallelepiped shape, and its dimension in a width direction (left-right direction) 51 is less than each of its dimension in a height direction (up-down direction) 52 and its dimension in a depth direction (front-rear direction) 53. The width direction 51, the height direction 52, and the depth direction 53 are perpendicular to each other. The width direction 51 extends in a horizontal direction. The depth direction 53 extends in a horizontal direction. The height direction 52 extends in the vertical direction. The insertion-removal direction 50 is parallel with the depth direction 53. The frame 31 comprises a front wall 40, a rear wall 41, a top wall 39, a bottom wall 42, and a right wall 38. The front wall 40 and the rear wall 41 at least partly overlap when viewed in the depth direction 53. The top wall 39 and the bottom wall 42 at least partly overlap when viewed in the height direction 52. The right wall 38 is positioned on one side of the frame 31 with respect to the width direction 51. In this embodiment, the right wall 38 is positioned on the right side of the frame 31 when the frame 31 is viewed from the front-wall 40 side. When the ink cartridge 30 is inserted into the cartridge mounting portion 110, the front wall 40 is positioned at the front side of the ink cartridge 30, and the rear wall 41 is positioned at the rear side of the ink cartridge 30. When the ink cartridge 30 is inserted into the cartridge mounting portion 110, the front wall 40 is oriented toward the insertion direction 56, and the rear wall 41 is oriented toward the removal direction 55. The rear wall 41 is positioned away from the front wall 40 in the removal direction 55. The frame 31 comprises a front outer face, a rear outer face, a top outer face, a bottom outer face, and a right outer face. The front wall 40 comprises the front outer face, the rear wall 41 comprises the rear outer face, the top wall 39 comprises the top outer face, the bottom wall 42 comprises the bottom outer face, and the right wall 38 comprises the right outer face.

Figure 6:
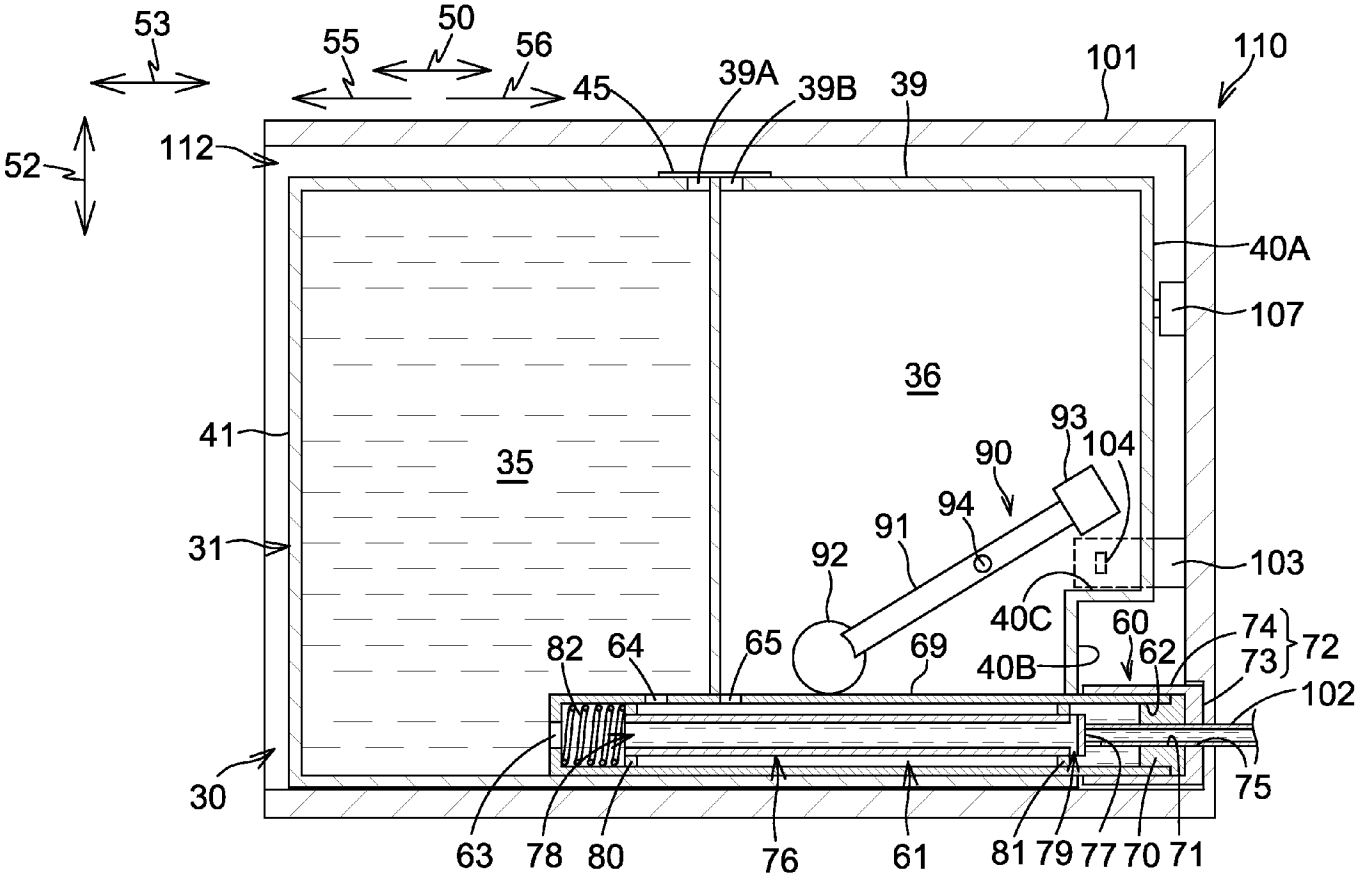
FIG. 6 is a cross-sectional view of the ink cartridge and the cartridge mounting portion when mounting of the ink cartridge to the cartridge mounting portion has been just completed.

The front wall 40 comprises a first wall 40A, a second wall 40B, and a connecting wall 40C. The first wall 40A and the second wall 40B at least partly overlap the rear wall 41 when viewed in the depth direction 53. The first wall 40A is positioned above the second wall 40B and is positioned further forward than the second wall 40B with respect to the insertion direction 56. In other words, the second wall 40B is positioned below the first wall 40A and is positioned further rearward with respect to the insertion direction 56. The connecting wall 40C intersects the first wall 40A and the second wall 40B and extends in parallel with the top wall 39 and the bottom wall 42. The connecting wall 40C is connected to the lower end of the first wall 40A at one end and is connected to the upper end of the second wall 40B at the other end. Referring to FIG. 6, the connecting wall 40C is positioned directly below the detection position.

Referring back to FIGS. 3A and 3B, the top wall 39 is connected to the upper end of the front wall 40, the upper end of the rear wall 41, and the upper end of the right wall 38. The bottom wall 42 is connected to the lower end of the front wall 40, the lower end of the rear wall 41, and the lower end of the right wall 38. The right wall 38 is connected to the right end of the front wall 40, the right end of the rear wall 41, the right end of the top wall 39, and the right end of the bottom wall 42. The other side of the frame 31 with respect to the width direction 51 is opened. In this embodiment, the left side of the frame 31, which is positioned on the left side of the frame 32 when the frame 31 is viewed from the front-wall 40 side, is opened. The frame 31 comprises a partitioning wall 43 partitioning the ink chamber into the first ink chamber 35 and the second ink chamber 36.

The ink cartridge 30 comprises a left wall 37 connected to the left side of the frame 31 with respect to the width direction 51. In this embodiment, the left wall 37 is a film 44. The film 44 and the frame 31 have almost the same outer contour when viewed in the width direction 51. The film 44 is welded to the left end of the front wall 40, the left end of the rear wall 41, the left end of the top wall 39, the left end of the bottom wall 42, and the left end of the partitioning wall 43 by heat. As such, it is possible to store ink in the ink chamber defined by the front wall 40, the rear wall 41, the top wall 39, the bottom wall 42, the right wall 38, and the left wall 37 (the film 44). The left wall 37 (the film 44) allows the light emitted from the light emitting portion 104 of the sensor 103 to pass therethrough. The ink cartridge 30 may comprise a cover covering the film 44 from outside. In such a case, the cover also allows the light emitted from the light emitting portion 104 of the sensor 103 to pass therethrough.

[First Ink Chamber 35, Second Ink Chamber 36]

The partitioning wall 43 is disposed between the front wall 40 and the rear wall 41 with respect to the depth direction 53. The partitioning wall 43 is connected to the inner surface of the left wall 37, the inner surface of the right wall 38, the inner surface of the top wall 39, and the inner surface of the bottom wall 42. The partitioning wall 43 partitions the inner space of the frame 31, i.e., the ink chamber into the first ink chamber 35 and the second ink chamber 36. The first ink chamber 35 is positioned in rear of the partitioning wall 43 with respect to the insertion direction 56 and is defined by the inner surface of the left wall 37, the inner surface of the right wall 38, the inner surface of the top wall 39, the inner surface of the bottom wall 42, the inner surface of the rear wall 41, the rear surface of the partitioning wall 43, and the outer surface of the wall of an outer cylindrical member 69 (described below) of the ink supply portion 60. The second ink chamber 36 is positioned in front of the partitioning wall 43 with respect to the insertion direction 56 and is defined by the inner surface of the left wall 37, the inner surface of the right wall 38, the inner surface of the top wall 39, the inner surface of the bottom wall 42, the inner surface of the front wall 40, and the front surface of the partitioning wall 43, and the outer surface of the wall of the outer cylindrical member 69 of the ink supply portion 60. The first ink chamber 35 and the second ink chamber 36 are aligned in the depth direction 53. The part of the wall of the outer cylindrical member 69 of the ink supply portion 60 positioned in rear of the partitioning wall 43 and the part of the bottom wall 42 positioned in rear of the partitioning wall 43 correspond to the bottom wall of the first ink chamber 35 defining the bottom end of the first ink chamber 35. The part of the wall of the outer cylindrical member 69 of the ink supply portion 60 positioned in front of the partitioning wall 43 and the part of the bottom wall 42 positioned in front of the partitioning wall 43 correspond to the bottom wall of the second ink chamber 36 defining the bottom end of the second ink chamber 36.

The top wall 39 has an opening 39A and an opening 39B formed therethrough. The opening 39A is formed through a part of the top wall 39 defining the top end of the first ink chamber 35, and the first ink chamber 35 can be in communication with the atmosphere outside the ink cartridge 30 through the opening 39A. The opening 39B is formed through a part of the top wall 39 defining the top end of the second ink chamber 36, and the second ink chamber 36 can be in communication with the atmosphere outside the ink cartridge 30 through the opening 39B. The positions of the openings 39A and 39B are not limited to the top wall, but can be any wall of the frame 31. Preferably, the openings 39A and 39B are positioned above the ink surface in the first ink chamber 35 and the second ink chamber 36.

The ink cartridge 30 comprises an air permeable film 45 attached to the top wall 39. The air permeable film 45 covers the opening 39A and the opening 39B. The air permeable film 45 allows air to pass therethrough, but blocks liquid from passing therethrough. The air permeable film 75 is a porous film and is made of polytetrafluoroethylene, polychlorotrifluoroethylene, tetrafluoroethylene—hexafluoropropylene compolymer, tetrafluoroethylene—perfluoroalkyl vinly ether copolymer, tetrafluoroethylene—ethylene copolymer or another known material.

[Movable Member 90]

The ink cartridge 30 comprises a movable member 90 positioned in the second ink chamber 36. The movable member 90 comprises a detection portion 93 and a float 92. In this description, when it is described that a movable member comprises a detection portion and a float it at least means that the movable member comprises the detection portion and the float as portions of the movable member, or that the movable member comprises the detection portion and the float as the entirety of the movable member. In this embodiment, the movable member 90 comprises an arm 91, and the detection portion 93 is positioned at one end of the arm 91 and the float 92 is positioned at the other end of the arm 91. The frame 31 comprises a shaft 94 extending in the width direction 51 from the inner surface of the right wall 38 to the left wall 37 (the film 44). The arm 91 is supported by the shaft 94 between the detection portion 93 and the float 92, such that the arm 91 can pivot about the shaft 94. The detection portion 93 is positioned closer to the front wall 40 than the float 92 is. The float 92 has a specific gravity which is less than the specific gravity of ink stored in the ink chamber. The float 92 is heavier than the detection portion 93.

The detection portion 93 comprises a light blocking portion. In this embodiment, the detection portion 93 comprises the light blocking portion as its entirety. That is, the detection portion 93 and the light blocking portion are one and the same member. The detection portion (light blocking portion) 93 is configured to block the light emitted by the light emitting portion 104 of the sensor 103. More specifically, when the detection portion (light blocking portion) 93 is in the detection position and the light emitted by the light emitting portion 104 of the sensor 103 reaches one side of the detection portion (light blocking portion) 93 in a direction (the width direction 51) perpendicular to the insertion-removal direction 50, an amount (intensity) of light coming out of the other side of the detection portion (light blocking portion) 93 and reaching the light receiving portion 105 of the sensor 103 is less than a predetermined amount (intensity), e.g., zero. The blocking of the light is caused by the detection portion (light blocking portion) 93 completely preventing the light from passing therethrough in width direction 51 perpendicular to the insertion-removal direction 50, by the detection portion (light blocking portion) 93 absorbing some amount of the light, by the detection portion (light blocking portion) 93 deflecting the light, by detection portion (light blocking portion) 93 totally reflecting the light, or by another phenomenon. For instance, the detection portion (light blocking portion) 93 is made of an opaque resin containing pigment, or made of a transparent or semi-transparent resin, but has a prism-like shape configured to deflect light, or comprises a reflection film, e.g., an aluminum film on its surface. On the other hand, when the detection portion (light blocking portion) 93 is not in the detection position and the light emitted by the light emitting portion 104 of the sensor 103 reaches one side of the ink cartridge 30 in the width direction 51 perpendicular to the insertion-removal direction 50, an amount (intensity) of light coming out of the other side of the ink cartridge 30 and reaching the light receiving portion 105 of the sensor 103 is greater than or equal to the predetermined amount (intensity). As such, the amount (intensity) of the light reaching the light receiving portion 105 of the sensor 103 depends on whether the detection portion (light blocking portion) 93 is in the detection position or not.

Figure 5:
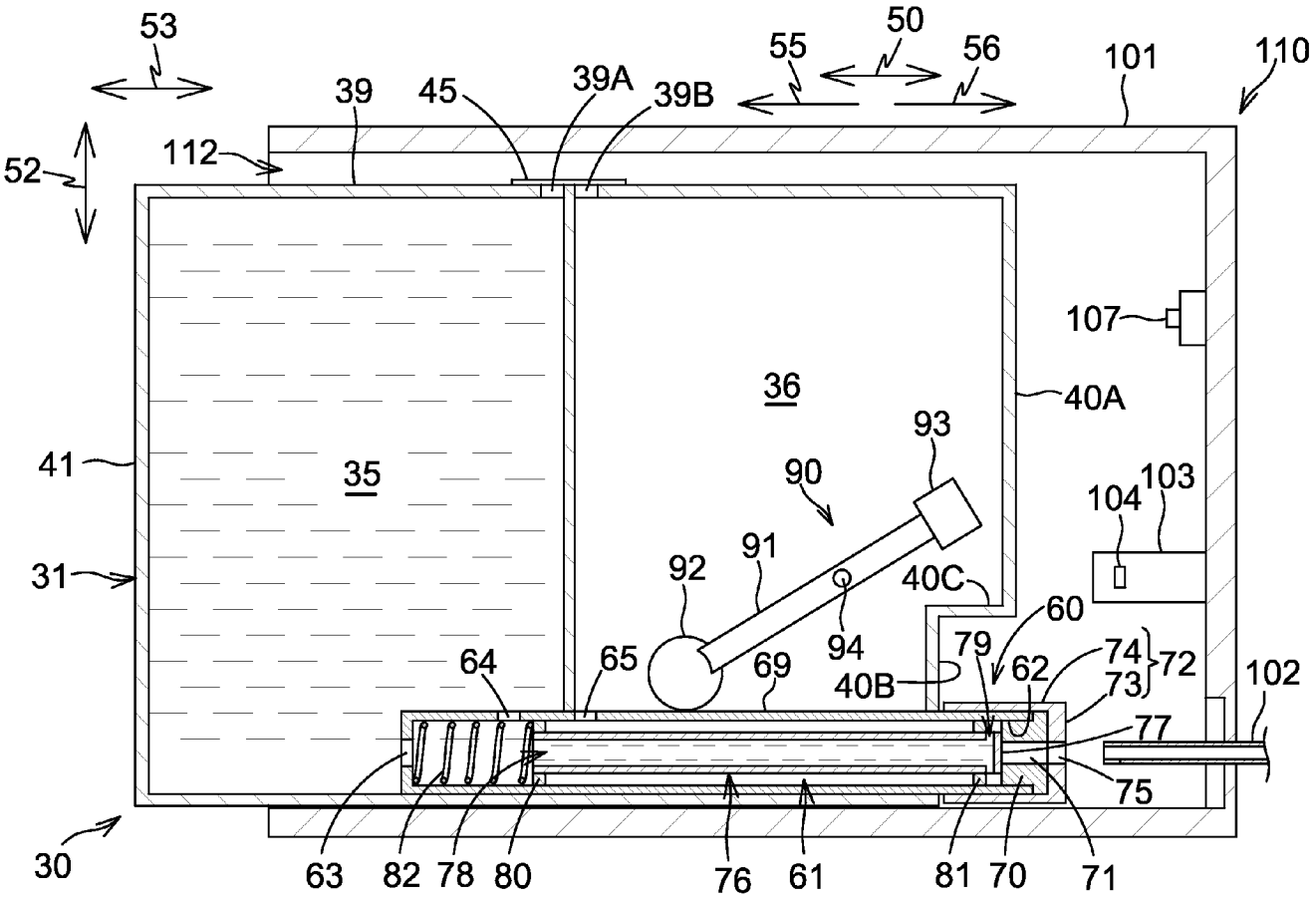
FIG. 5 is a cross-sectional view of the ink cartridge and the cartridge mounting portion during insertion of the ink cartridge into the cartridge mounting portion.
Figure 7:
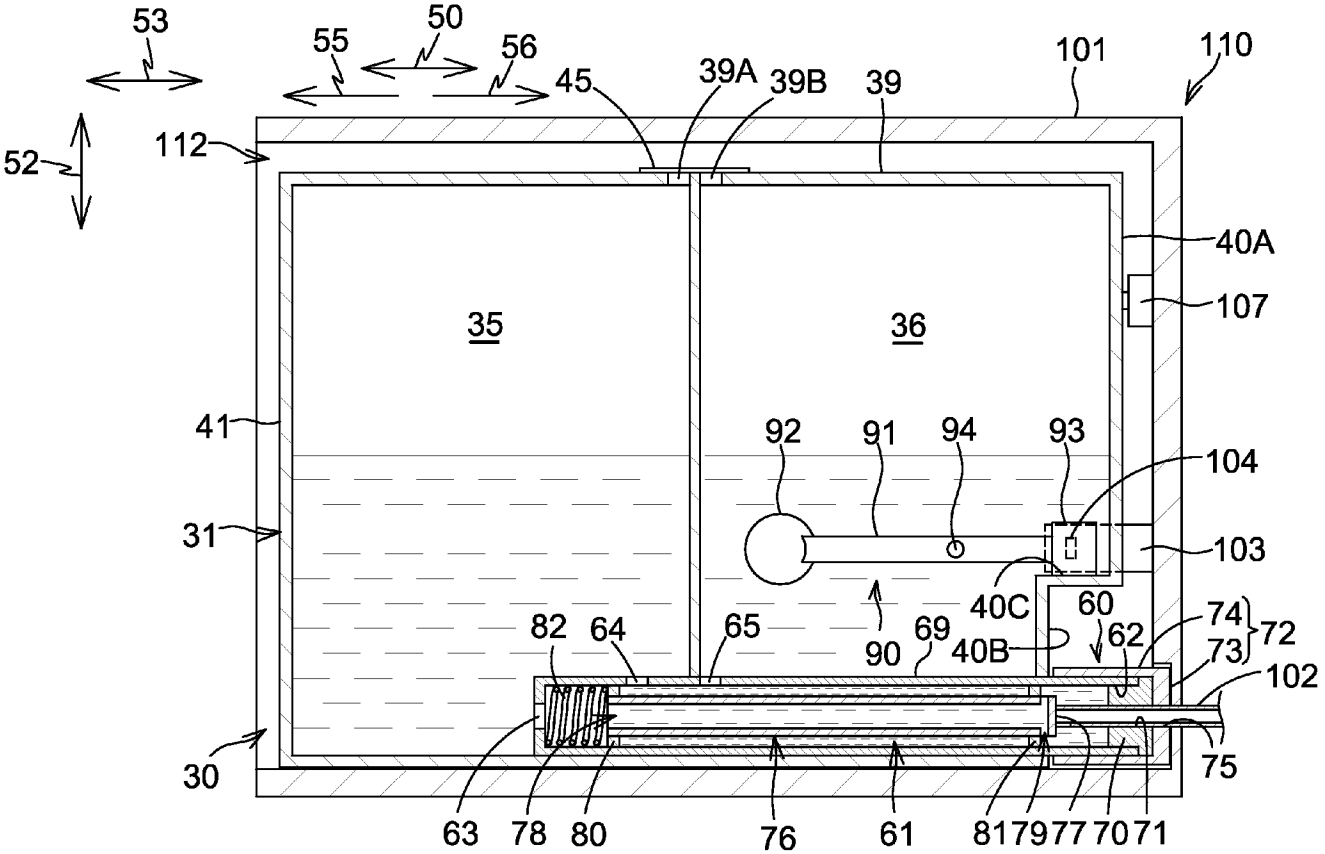
FIG. 7 is a cross-sectional view of the ink cartridge and the cartridge mounting portion when mounting of the ink cartridge to the cartridge mounting portion has been completed and a detection portion reaches a detection position.
Figure 8:
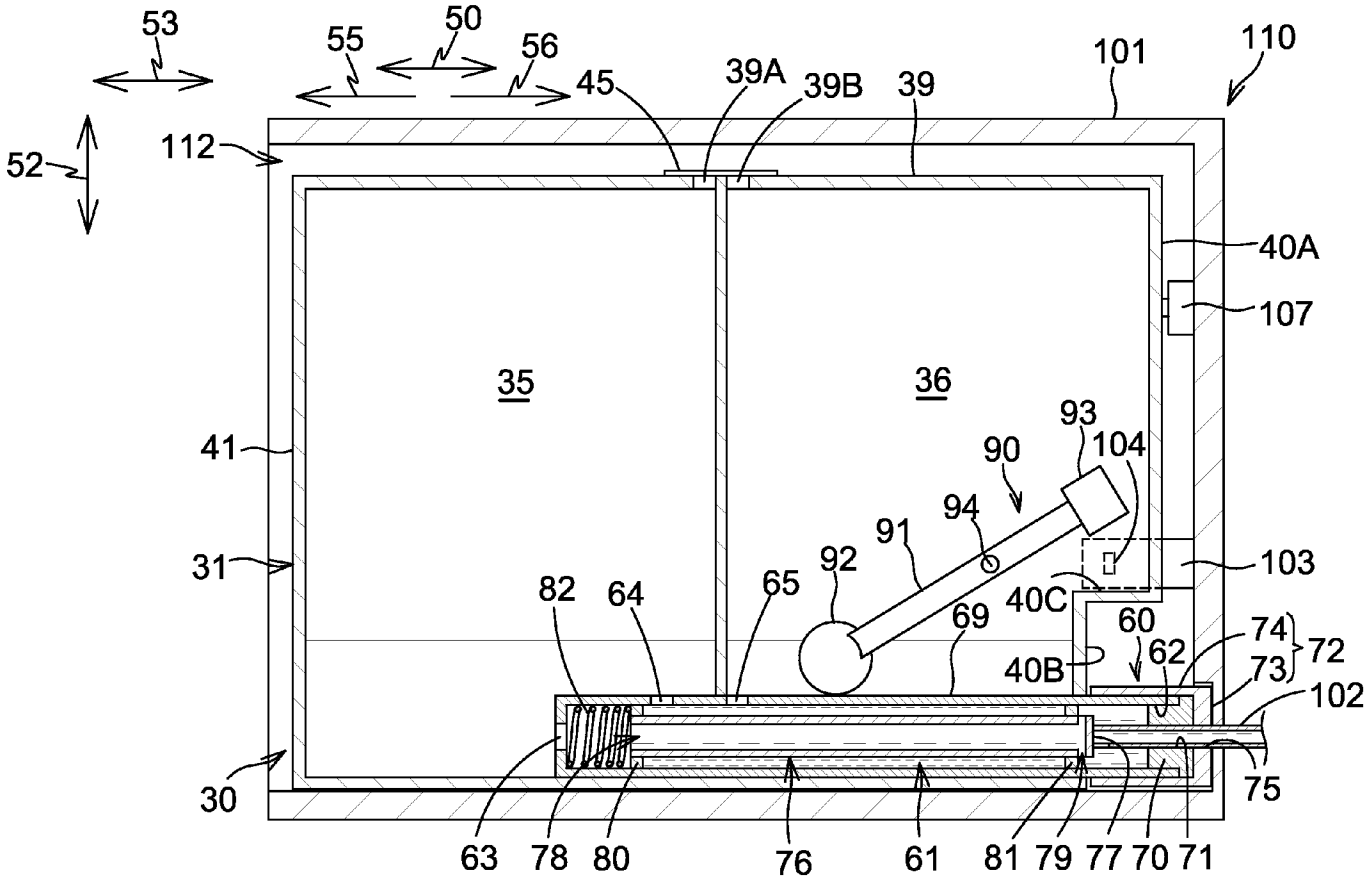
FIG. 8 is a cross-sectional view of the ink cartridge and the cartridge mounting portion when mounting of the ink cartridge to the cartridge mounting portion has been completed and the detection portion has moved out of a detection position.

The movable member 90 is configured to pivot about the shaft 94 depending on the ink amount in the second ink chamber 36. When the ink surface in the second ink chamber 36 moves up, the float 92 moves up and the movable member 90 pivots in the clockwise direction in FIG. 5, such that the detection portion (light blocking portion) 93 moves down. When the ink surface in the second ink chamber 36 lowers, the float 92 moves down and the movable member 90 pivots in the counter-clockwise direction in FIG. 5, such that the detection portion (light blocking portion) 93 moves up. When the amount of ink stored in the second ink chamber 36 is small or zero, the float 92 is positioned close to or contacts the bottom wall of the second ink chamber 36, i.e., is positioned closer to or contacts the outer cylindrical member 69 of the ink supply portion 60, and the detection portion (light blocking portion) 93 is out of the detection position as shown in FIGS. 5, 6, and 8. When the amount ink stored in the second ink chamber 36 is large, the float 92 is submerged in ink, and the detection portion (light blocking portion) 93 is in the detection position as shown in FIG. 7.

[Ink Supply Portion 60]

Referring to FIGS. 3A, 3B, and 5-9, the ink supply portion 60 comprises an outer cylindrical member 69, a valve seat 70, a cap 72, an inner cylindrical member 76, a first sealing member 80, a second sealing member 81, and a coil spring 82. The inner space of the outer cylindrical member 69 is an ink supply chamber 61 that forms an ink supply passage. The outer cylindrical member 69 and inner cylindrical member 76 are cylindrically-shaped in the illustrated example and thus referred to as respective "cylindrical" members, though other shapes could be used for the outer and inner members 69, 76. The outer cylindrical member 69 has an opening 62, an opening 63, and opening 64, and an opening 65 formed therethrough. The ink supply chamber 61 can be in communication with the exterior of the outer cylindrical member 69 via the openings 62, 63, 64, and 65. The outer cylindrical member 69 extends in the depth direction 53. The opening 62 is formed at the front end of the outer cylindrical member 69 and the opening 63 is formed at the rear end of the outer cylindrical member 69. The openings 64 and 65 are formed at the circumferential wall of the outer cylindrical member 69 of the ink supply portion 60. The openings 64 and 65 are positioned away from each other in the depth direction 53. The opening 64 is positioned further rearward than the opening 65.

The second wall 40B of the front wall 40 has an opening 40D formed therethrough and the partitioning wall 43 has an opening 43A formed therethrough. The opening 40D and the opening 43A are aligned in the depth direction 53. The ink supply portion 60 is inserted through the openings 40D and 43A and fixed to the frame 31. For instance, the gap between the circumferential wall of the outer cylindrical member 69 and the second wall 40B of the front wall 40 at the opening 40D is filled with adhesive, and the gap between the circumferential wall of the outer cylindrical member 69 and the portioning wall 43 at the opening 43A is filled with adhesive. Alternatively, the circumferential wall of the outer cylindrical member 69 and the second wall 40B of the front wall 40 are welded at the opening 40D without any gap formed therebetween, and the circumferential wall of the outer cylindrical member 69 and the partitioning wall 43 are welded at the opening 43A without any gap formed therebetween. Since the ink supply portion 60 extends through the front wall 40, the ink supply portion 60 is positioned at the front wall 40.

The wall of the outer cylindrical member 69 forms a part of the bottom wall of the first ink chamber 35 and a part of the bottom wall of the second ink chamber 36. The ink supply chamber 61 is positioned below a part of the first ink chamber 35. The ink supply chamber 61 also is positioned below a part of the second ink chamber 36.

The front end of the ink supply portion 60 is positioned outside of the frame 31. Therefore, the opening 62 is positioned outside of the ink cartridge 30. The openings 63 and 64 face the first ink chamber 35. The opening 65 faces the second ink chamber 36. The ink supply chamber 61 can communicate with the exterior of the ink cartridge 30 through the opening 62, the ink supply chamber 61 can communicate with the first ink chamber 35 through the openings 63 and 64, and the ink supply chamber 61 can communicate with the second ink chamber 36 through the opening 65.

The valve seat 70 and the cap 72 are attached to the front end of the outer cylindrical member 69. The valve seat 70 has substantially a disc shape. The outer diameter of the valve seat 70 is equal to or almost equal to the outer diameter of the outer cylindrical member 69 before inserted into the ink supply chamber 61. The valve seat 70 is made of an elastic material such as rubber. A part of the valve seat 70 is inserted into the ink supply chamber 61 through the opening 62 and sealingly contacts the inner surface of the outer cylindrical member 69. Another part of the valve seat 70 is positioned outside the ink supply chamber 61 and contacts the front end of the outer cylindrical member 69 where the opening 62 is provided. The valve seat 70 has an ink supply opening 71 formed therethrough in the depth direction 53. The ink supply chamber 61 can be communication with the exterior of the ink cartridge 30 through the ink supply opening 71. The diameter of the ink supply opening 71 is slightly less than the outer diameter of the hollow tube 102.

The cap 72 comprises a circular lid portion 73 and a cylindrical portion 74 extending from the outer edge of the lid portion 73. The lid portion 73 has an opening 75 formed therethrough in the depth direction 53 at the center of the lid portion 73. The diameter of the opening 75 is greater than the diameter of the ink supply opening 71 of the valve seat 70. The lid portion 73 contacts the valve seat 70 in the depth direction 53 on the side opposite from the ink supply chamber 61. Therefore, the valve seat 70 is sandwiched between the lid portion 73 and the front end of the outer cylindrical member 69 in the depth direction 53. The cylindrical portion 74 covers the circumferential surface of the valve seat 70 and a part of the circumferential surface of the outer cylindrical member 69. The cap 72 is fixedly attached to, e.g., welded to, outer cylindrical member 69 or the front wall 40 for retaining the valve seat 70 at the front end of the outer cylindrical member 69.

The inner cylindrical member 76, the first sealing member 80, the second sealing member 81, and the coil spring 82 are disposed in the ink supply chamber 61. In the illustrated example, the inner cylindrical member 76 has substantially a cylindrical shape having an inner space. The inner cylindrical member 76 has a valve member 77 at its front end wall. The valve member 77 is configured to contact the valve seat 70. The inner cylindrical member 76 has an opening 78 at its rear end. The inner cylindrical member 76 has an opening 79 formed through the circumferential wall of the inner cylindrical member 76 at a position adjacent to the valve member 77. The inner space of the inner cylindrical member 76 can be in communication with the exterior of the inner cylindrical member 76 through the openings 78, 79. The outer diameter of the inner cylindrical member 76 is less than the inner diameter of the outer cylindrical member 69, i.e., the diameter of the ink supply chamber 61. The inner cylindrical member 76 is disposed in the outer cylindrical member 69 with the valve member 77 facing the valve seat 70 and the opening 78 facing the opening 63. The inner cylindrical member 76 is movable in the depth direction 53 relative to the outer cylindrical member 69. The inner cylindrical member 76 has a rigidity greater than the rigidity of the first sealing member 80 and the second sealing member 81. For instance, the inner cylindrical member 76 is made of synthetic resin. The ink supply opening 71 and the inner cylindrical member 76 is aligned in the depth direction 53.

Each of the first sealing member 80 and the second sealing member 81 extends continuously in the circumferential direction around the circumferential wall of the inner cylindrical member 76. Each of the first sealing member 80 and the second sealing member 81 may be an O-ring through which the inner cylindrical member 76 is inserted. Each of the first sealing member 80 and the second sealing member 81 is made of an elastic material such as rubber. The first sealing member 80 and the second sealing member 81 are positioned away from each other in the depth direction 53. The first sealing member 80 is positioned further rearward than the second sealing member 81 is, i.e., the first sealing member 80 is closer to the opening 63 than the second sealing member 81 is. In other words, the second sealing member 81 is positioned further forward than the first sealing member 80 is, i.e., the second sealing member 81 is positioned closer to the opening 62 than the first sealing member 80 is. The second sealing member 81 is positioned further rearward than the opening 79 is.

Each of the first sealing member 80 and the second sealing member 81 sealingly contacts the inner surface of the circumferential wall of the outer cylindrical member 69 and the outer surface of the circumferential wall of the inner cylindrical member 76. When the first sealing member 80 and the second sealing member 81 are attached to the inner cylindrical member 76, but not inserted into the outer cylindrical member 69, the outer diameter of each of the first sealing member 80 and the second sealing member 81 is greater than the inner diameter of the outer cylindrical member 69. Therefore, each of the first sealing member 80 and the second sealing member 81 is elastically deformed between the inner surface of the circumferential wall of the outer cylindrical member 69 and the outer surface of the circumferential wall of the inner cylindrical member 76, such that the outer diameter thereof is reduced. The first sealing member 80 and the second sealing member 81 moves with the inner cylindrical member 76 in the depth direction 53 in the ink supply chamber 61. When the first sealing member 80 and the second sealing member 81 moves with the inner cylindrical member 76, the first sealing member 80 and the second sealing member 81 slides on the inner surface of the outer cylindrical member 69.

The ink supply chamber 61 has a first space positioned in rear of the first sealing member 80 and has a second space positioned in front of the second sealing member 81. The communication between the first space and the second space outside the inner cylindrical member 76 is blocked by the first sealing member 80 and the second sealing member 81. On the other hand, the first space and the second space are in communication with each other through the opening 78, the opening 79, and the inner space of the inner cylindrical member 76. The opening 63, the first space, the opening 78, the inner space of the inner cylindrical member 76, the opening 79, the second space forms an ink supply path through which the first ink chamber 35 can be in communication with the exterior of the ink cartridge 30.

The coil spring 82 is positioned between the inner cylindrical member 76 and the rear end wall of the outer cylindrical member 69 where the opening 63 is formed. More specifically, one end of the coil spring 82 contacts a portion surrounding the opening 78 and the other end of the coil spring 82 contacts a portion surrounding the opening 63. The coil spring 82 functions as a biasing member and thus is configured to bias the inner cylindrical member 76 forward in the depth direction 53. In another embodiment, a leaf spring or any known biasing member can be used instead of the coil spring 82.

Referring to FIG. 5, the coil spring 82 biases the inner cylindrical member 76 into a first position. When the inner cylindrical member 76 is in the first position, the valve member 77 sealingly contacts a portion of the valve seat 70 surrounding the ink supply opening 71, such that the valve member 77 closes the ink supply opening 71. This position of the valve member 77 is a close position. Moreover, the first sealing member 80 sealingly contacts the inner surface of the outer cylindrical member 69 at a position in front of the opening 64 and in rear of the opening 65. The second sealing member 81 sealingly contacts the inner surface of the outer cylindrical member 69 at a portion in rear of the opening 62, the ink supply opening 71, the opening 75, and the opening 79, and in front of the opening 65. The communication between the opening 65 and the opening 62 is blocked. The communication between the opening 65 and the ink supply opening 71 is blocked. The communication between the opening 65 and the opening 75 is blocked. The communication between the opening 65 and the opening 79 is blocked. The communication between the opening 65 and the opening 64 is blocked. The inner cylindrical member 76, the first sealing member 80, and the second sealing member 81 are a movable blocking member configured to block the communication between the first liquid chamber 35 and the second liquid chamber 36 through the ink supply chamber 61. Ink is prevented from flowing from the first ink chamber 35 to the second ink chamber 36 through the ink supply chamber 61. The position of the inner cylindrical member 76, the first sealing member 80, and the second sealing member 81 is a block position.

Referring to FIG. 6, when the inner cylindrical member 76 is in a second position which is closer to the rear wall 41 than the first position is, the valve member 77 is positioned away from the valve seat 70, such that the valve member 77 opens the ink supply opening 71. This position of the valve member 77 is an open position, which is closer to the rear wall 41 than the close position is. Moreover, the first sealing member 80 sealingly contacts the inner surface of the outer cylindrical member 69 at a position in front of the opening 63 and in rear of the opening 64. The second sealing member 81 sealingly contacts the inner surface of the outer cylindrical member 69 at a position in rear of the opening 62, the ink supply opening 71, the opening 75, and the opening 79, and in front of the opening 65. The communication between the opening 65 and opening 64 is established. The position of the inner cylindrical member 76, the first sealing member 80, and the second sealing member 81 is a communication position. The communication between the first liquid chamber 35 and the second liquid chamber 36 through the ink supply chamber 61 is established. Ink is allowed to flow from the first liquid chamber 35 to the second liquid chamber 36 through a communication path, i.e., the opening 64, the ink supply chamber 61, and the opening 65. The communication position is closer to the rear wall 41 than the block position is.

The communication path, i.e., the opening 64, the ink supply chamber 61, and the opening 65, is positioned in a lower half portion of the ink cartridge 30. A portion of the first ink chamber 35 and a portion of the second ink chamber 36 are positioned in an upper half portion of the ink cartridge 30. Therefore, the portion of the first ink chamber 35 and the portion of the second ink chamber 36 are positioned above the communication path, i.e., the opening 64, the ink supply chamber 61, and the opening 65.

Before the ink cartridge 30 is mounted to the cartridge mounting portion 110, i.e., when the inner cylindrical member 76, the first sealing member 80, and the second sealing member 81 are initially in the block position, the first ink chamber 35 stores a first initial amount of ink therein and the second ink chamber 36 stores a second initial amount of ink therein. The second initial amount of ink may be zero, i.e., the second ink chamber 36 may not store ink therein. The first initial amount of ink in the first ink chamber 35 has a first initial ink surface, and the second initial amount of ink in the second ink chamber 36 has a second initial ink surface when the second initial amount of ink is not zero. The first initial ink surface is positioned above the second initial ink surface. The second ink chamber 36 has a space to be filled with ink when the communication between the first ink chamber 35 and the second ink chamber 36 is established. In this embodiment, the second initial amount is zero.

[Controller 130]

Figure 4:
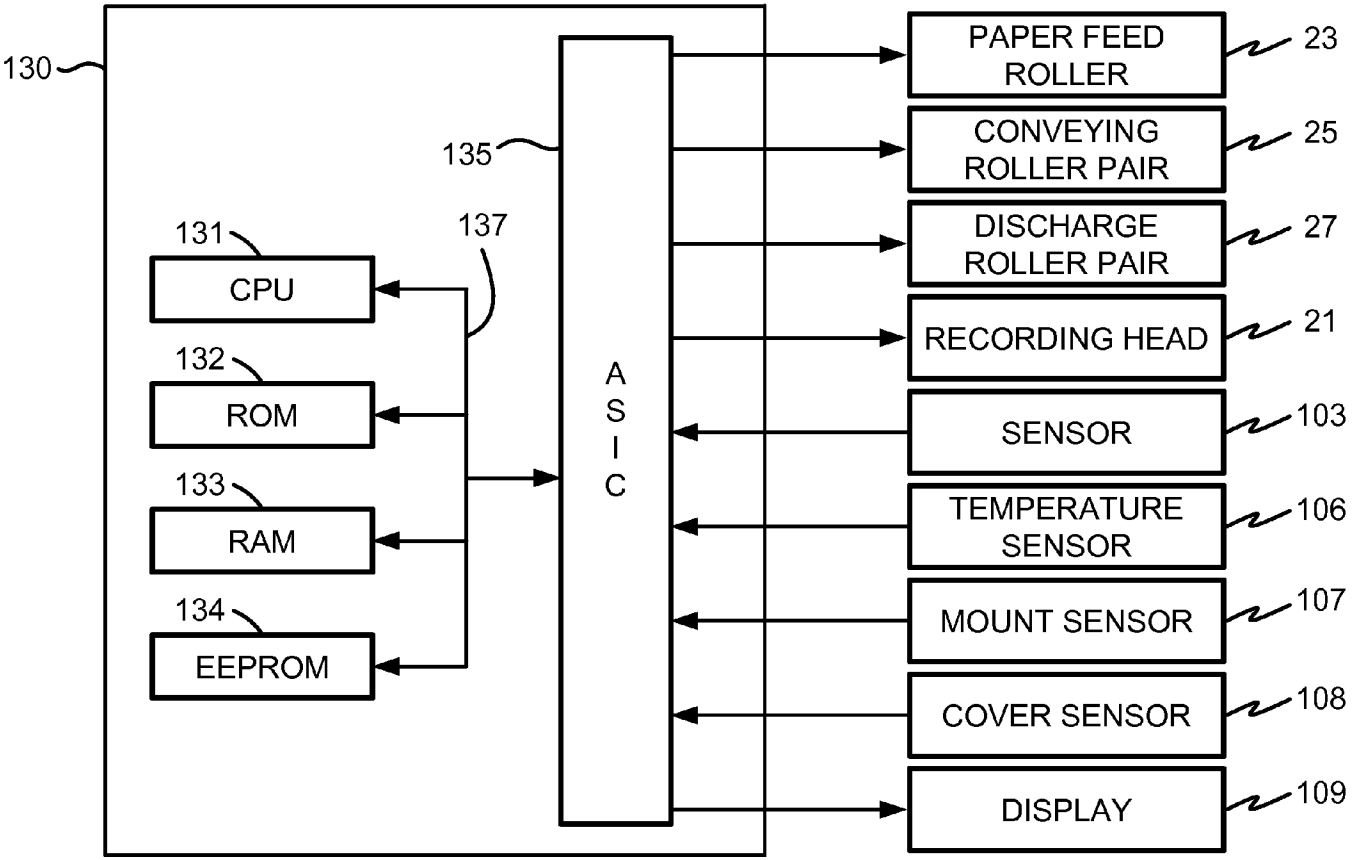
FIG. 4 is a functional block diagram of the printer.

Referring to FIG. 4, the printer 10 comprises a controller 130. The controller 130 comprises a CPU 131, a ROM 132, a RAM 133, an EEPROM 134, and an ASIC 135, which are connected to each other by an internal bus 137. The ROM 132 stores programs for the CPU 131 to control various operations of the printer 10. The RAM 133 is used as a storage area for temporarily store date and signals for the CPU 131 to use in executing the programs and as a working area for date processing. The EEPROM 134 stores settings and flags which may be retained even after the power is off. One chip may comprise the CPU 131, the ROM 132, the RAM 133, the EEPROM 134, and the ASIC 135, or one chip may comprise some of the CPU 131, the ROM 132, the RAM 133, the EEPROM 134, and the ASIC 135, and another chip may comprise the other of the CPU 131, the ROM 132, the RAM 133, the EEPROM 134, and the ASIC 135.

The controller 130 is configured to rotate the paper feed roller 23, the conveying roller pair 25, and the discharge roller pair 27 by driving a motor (not shown). The controller 130 is configured to control the recording head 21 to eject ink from the nozzles 29. More specifically, the controller 130 is configured to send to the head control board 21A control signals indicating the values of driving voltages to be applied to the piezoelectric actuators 29A. The head control board 21A is configured to apply the driving voltages to the piezoelectric actuators 29A based on the control signals received from the controller 130, such that ink is ejected from the nozzles 29. The printer 10 also comprises a display 109, and the controller 130 is configured to control the display 109 to display information about the printer 10 and the ink cartridge 30 or a variety of messages.

The printer 10 also comprises a temperature sensor 106 and a cover sensor 108, and the controller 130 is configured to receive the detection signals output from the sensor 103, signals output from the temperature sensor 106, the detection signals output from the mount sensor 107, and signals output from the cover sensor 108. The temperature sensor 106 is configured to output signals based on temperature. Where the temperature sensor 106 senses temperature is not limited to a specific position. The temperature sensor 103 may be positioned in the cartridge mounting portion 110, or may be positioned on an outer surface of the printer 10. The cover sensor 108 is configured to output different signals based on whether the cover for the opening 112 of the cartridge mounting portion 110 is opened or closed.

The ink cartridge 30 is inserted into the cartridge mounting portion 110 when the cover of the cartridge mounting portion 110 is opened. Referring to FIG. 5, when the ink cartridge 30 is being inserted into the cartridge mounting portion 110, the inner cylindrical member 76 is in the first position, i.e., the valve member 77 is in the close position, and the inner cylindrical member 76, the first sealing member 80, and the second sealing member 81 are in the block position. The detection portion 93 is not in the detection position. The sensor 103 outputs the High-level signal to the controller 130, and the mount sensor 107 outputs the Low-level signal to the controller 130.

Referring to FIG. 6, when the ink cartridge 30 is further inserted into the cartridge mounting portion 110, the inner cylindrical member 76 is pushed by the hollow tube 102 inserted through the opening 75 and the ink supply opening 71. That is, the hollow tube 102 contacts the valve member 77 and moves the inner cylindrical member 76. The inner cylindrical member 76 moves from the first position to the second position against a biasing force of the coil spring 82, i.e., the valve member 77 moves from the close position to the open position, and the inner cylindrical member 76, the first sealing member 80, and the second sealing member 81 move from the block position to the communication position.

The outer surface of the hollow tube 102 sealingly contacts a surface of the valve seat 70 defining the ink supply opening 71 while pushing the valve seat 70 radially. The distal end of the hollow tube 102 is positioned in the ink supply chamber 61. As a result, ink can flow out of the first ink chamber 35 into the hollow tube 102 through the opening 63, the first space of the ink supply chamber 61, the opening 78, the inner space of the inner cylindrical member 76, the opening 79, and the second space of the ink supply chamber 76.

In FIG. 6, ink has not flown into the second ink chamber 36 because the mounting of the ink cartridge 30 to the cartridge mounting portion 100 has been just completed. Therefore, the detection portion 96 still is not in the detection position. The sensor 103 outputs the High-level signal to the controller 130. On the other hand the mount sensor 107 outputs the High-level signal to the controller 130 because the ink cartridge 30 is in the mount position and pushes the mount sensor 107.

Referring to FIG. 7, as time passes from the state shown in FIG. 6, ink flows from the first ink chamber 35 into the second ink chamber 36 through the communication path, i.e., the opening 64, the ink supply chamber 61, and the opening 65. Finally the height of the ink surface in the first ink chamber 35 and the height of the ink surface in the second ink chamber 36 becomes the same. As the ink surface in the second ink chamber 35 moves up, the movable member 90 pivots in a first direction, i.e., the clockwise direction in FIG. 7, until the detection portion 93 contacts the connecting wall 40C. As a result, the detection portion 96 reaches the detection position and blocks the light emitted by the light emitting portion 104. The sensor 103 outputs the Low-level signal to the controller 130.

Referring to FIG. 8, as the recording head 21 ejects ink, ink flows out of the first ink chamber 35 and is supplied to the recording head 21. As ink is consumed from the first ink chamber 35, ink flows from the second ink chamber 36 back to the first ink chamber 35 through the communication path. As ink surface in the second ink chamber 36 lowers, the float 92 moves down and the movable member 90 pivots in a second direction, i.e., the counter-clockwise direction in FIG. 8. The detection portion 93 moves out of the detection position, and the sensor outputs the High-level signal to the controller 130.

When a user thinks that the mounting of the ink cartridge 30 to the cartridge mounting portion 110 has been completed, the user closes the cover of the cartridge mounting portion 110 to cover the opening 112. Even if the mounting of the ink cartridge 30 to the cartridge mounting portion 110 has not been completed, the closed cover contacts and pushes the ink cartridge 30 in the insertion direction 56 to complete the mounting of the ink cartridge 30 to the cartridge mounting portion 110.

[Processes Performed by the Controller 130]

Figure 9:
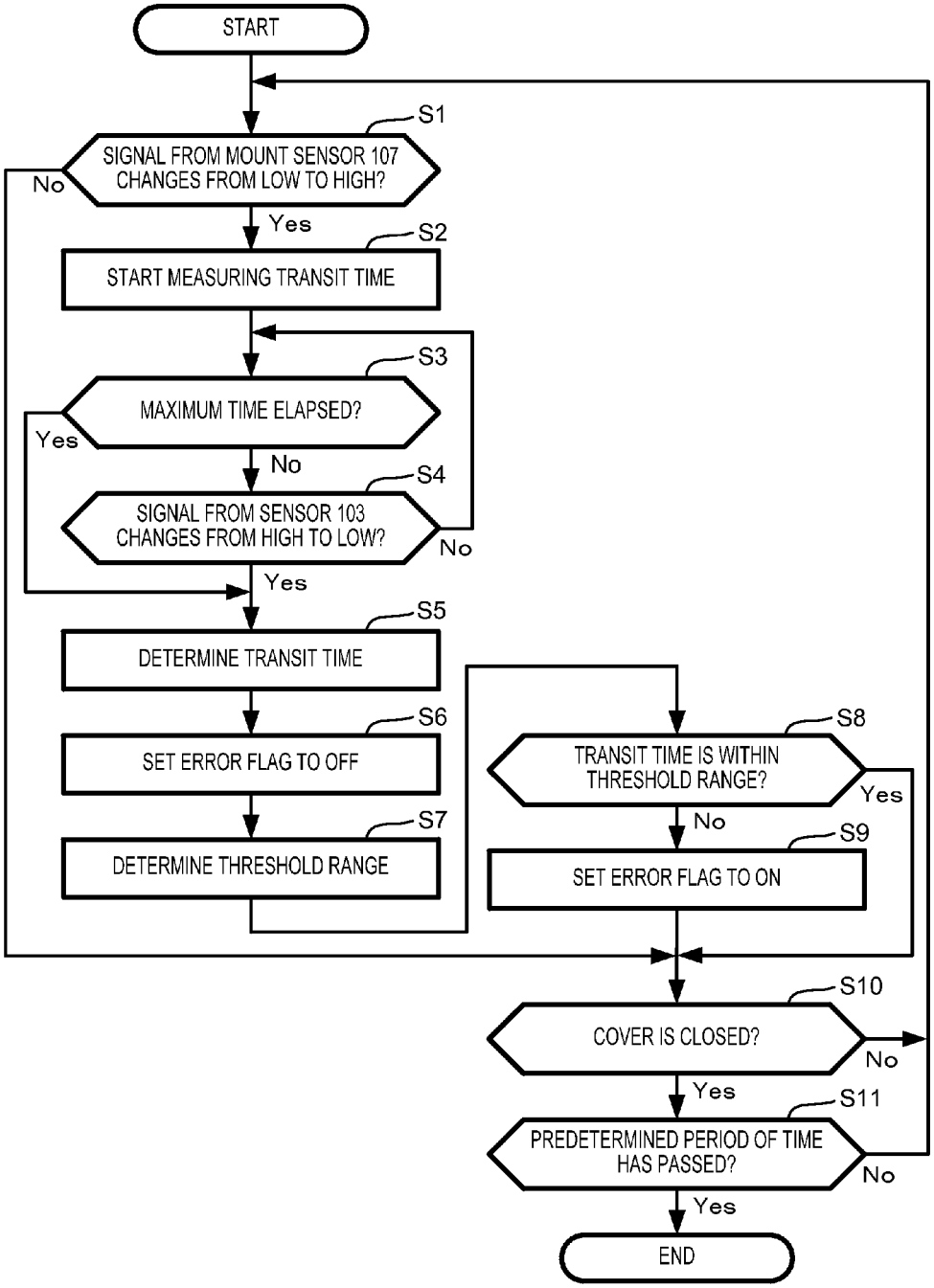
FIG. 9 is a flow chart of processes performed by a controller when a cover of the cartridge mounting portion is opened and a mount sensor outputs a Low-level signal.

The controller 130 is configured to perform the processes of FIG. 9 when the controller 130 receives the signal from the cover sensor 108 indicating that the cover of the cartridge mounting portion 110 is opened and receives the Low-level signal from the mount sensor 107. In other words, the processes of FIG. 9 start when the cover of the cartridge mounting portion 110 is opened and the ink cartridge 30 is removed. When the cartridge 30 is not mounted to the cartridge mounting portion 110 before the cover of the cartridge mounting portion 110 is opened, the processes of FIG. 9 start when the cover of the cartridge mounting portion 110 is opened.

The controller 130 starts measuring a transit time at step S2 if the detection signal output from the mount sensor 107 changes from the Low-level signal to the High-level signal (step S1: Yes). If the detection signal output from the mount sensor 107 does not change from the Low-level signal to the High-level signal (step S1: No), the controller 130 performs the process of step S10 (described later). For instance, the situation in which the detection signal output from the mount sensor 107 does not change from the Low-level signal to the High-level signal (step S1: No) corresponds to a situation in which a new ink cartridge 30 has not been mounted to the cartridge mounting portion 110.

Subsequently, the controller 130 determines whether the elapsed time since the controller 130 starts measuring the transit time has exceeded a predetermined maximum time at step S3. If the elapsed time has exceeded the maximum time (step S3: Yes), the controller 130 performs the process of step S5 (described later). If the elapsed time has not exceeded the maximum time (step S3: No), the controller 130 determines whether the detection signal output from the sensor 103 changes from the High-level signal to the Low-level signal at step S4. If the detection signal output from the sensor 103 does not change from the High-level signal to the Low-level signal (step S4: No), the controller 103 performs the process of step S3 again. If the detection signal output from the sensor 103 changes from the High-level signal to the Low-level signal (step S4: Yes), the controller 103 determines the transit time at step S5.

The transit time is a period of time from when the detection signal output from the mount sensor 107 changes from the Low-level signal to the High-level signal (step S1: Yes) to when the detection signal output from the sensor 103 changes from the High-level signal to the Low-level signal (step S4: Yes). In other words, the transit time is a time from when the communication between the first ink chamber 35 and the second ink chamber 36 is established to when the detection portion 93 reaches the detection position. If the elapsed time has exceeded the maximum time (step S3: Yes), the controller 130 considers the maximum time as the transit time.

The situation in which the elapsed time has exceeded the maximum time (step S3: Yes) corresponds to a situation in which ink flows very slowly from the first ink chamber 35 to the second ink chamber 36 through the communication path or does not flow from the first ink chamber 35 to the second ink chamber 36. A reason for the slow movement of ink may be that the viscosity of ink stored in the ink chamber has become high.

The timing when the first ink chamber 35 and the second ink chamber 36 are brought into communication through the communication path and the timing when the output signal from the mount sensor 107 changes from the Low-level signal to the High-level signal are the same or close. Therefore, the latter timing is presumed as the former timing. The controller 130 measures, as the transit time, a time from when the detection signal output from the mount sensor 107 changes from the Low-level signal to the High-level signal to when the detection signal output from the sensor 103 changes from the High-level signal to the Low-level signal.

Subsequently, the controller 130 resets an error flag, i.e., sets the error flag to "OFF" at step S6. The error flag is set to "ON" when the transit time is not within a threshold range (step S8: No). The error flag is set for each ink cartridge 30. The controller 130 stores the error flag in the EEPROM 134.

Subsequently, the controller 130 determines the threshold range based on the signal output from the temperature sensor 106 at step S7. The threshold range is compared with the transit time for estimating the viscosity of ink stored in the first ink chamber 35 and the second ink chamber 36. If the signal output from the temperature sensor 106 indicates that the temperature is relatively high, the controller 130 sets at least one of the upper limit value and the lower limit value of the threshold range lower. In other words, if the signal output from the temperature sensor 106 indicates that the temperature is relatively low, the controller 130 sets at least one of the upper limit value and the lower limit value of the threshold range higher.

Subsequently, the controller 130 compares the transit time determined at step S5 with the threshold range determined at step S7 and determines whether or not the transit time is within the threshold range at step S8. If the transit time is below the lower limit value, it is estimated that the viscosity of ink is too low. If the transit time is above the upper limit value, it is estimated that the viscosity of ink is too high. If the transit time is out of the threshold range (step S8: No), the controller 130 sets the error flag to "ON" at step S9. If the transit time is within the threshold range (step S8: Yes), the controller 130 skips the process of step S9.

Subsequently, the controller 130 determines whether or not the cover sensor 108 outputs the signal indicating that the cover of the cartridge mounting potion 110 is closed at step S10. If it is determined that the cover is open (step S10: No), the controller 130 repeats the process of step S1 and the processes that follow step S1. If it is determined that the cover is closed (step S10: Yes), the controller 130 determines at step S11 whether or not a predetermined period of time has passed since it is determined that the cover is closed at step S10.

If the predetermined period of time has passed (step S11: Yes), the controller 130 completes the processes of FIG. 9. If the predetermined period of time has not passed (step S11: No), the controller 130 repeats the process of step S1 and the processes that follow step S1. If the controller 130 determines that the cover of the cartridge mounting portion 110 is open (step S10: No) when the controller 130 is repeating the process of step S1 and the processes that follow step S1, the controller 130 cancels the counting of time it started when it determined that the cover was closed (step S10: Yes).

Figure 10:
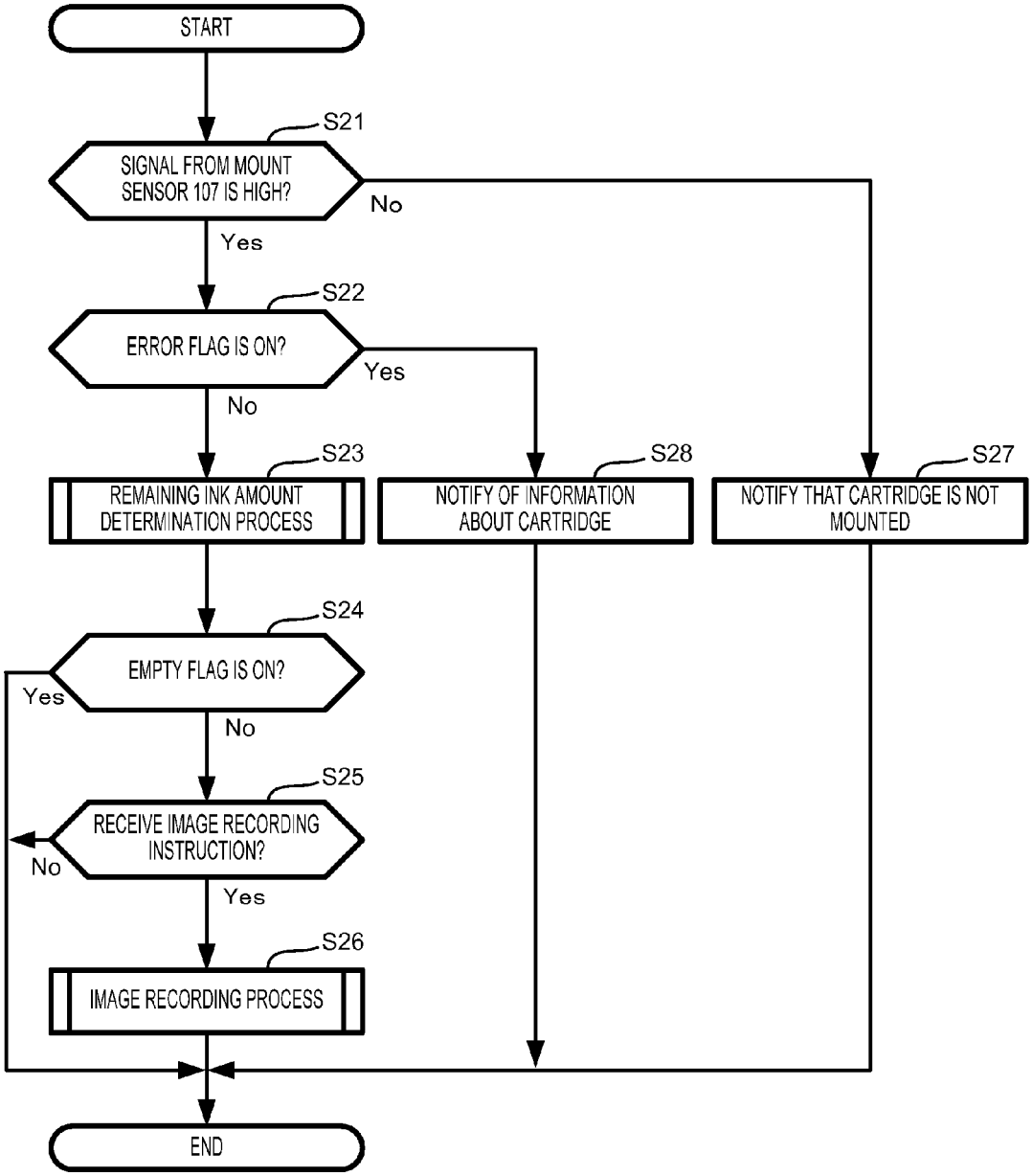
FIG. 10 is a flow chart of processes performed by the controller when the processes of FIG. 9 have been completed and the cover of the cartridge mounting portion is closed.

After completing the processes of FIG. 9, the controller 130 performs the processes of FIG. 10 repeatedly at a predetermined interval when the controller 130 receives from the cover sensor 108 the signal indicating that the cover of the cartridge mounting portion 110 is closed.

The controller 130 determines whether the mount sensor 107 outputs the High-level signal at step S21. If the mount sensor 107 outputs the Low-level signal (step S21: No), the controller 130 notifies a user that the ink cartridge 30 is not mounted at step S27, and completes the processes of FIG. 10. How to notify a user is not limited to a specific way, but the controller 130 may have the display 109 display a message or have a speaker (not shown) of the printer 10 sound out an audio message.

If the mount sensor 107 outputs the High-level signal (step S21: Yes), the controller 130 determines whether the error flag is set to "ON" at step S22. If the error flag is set to "ON" (step S22: Yes), the controller 130 performs the process of step S28. The controller 130 notifies a user of information about the ink cartridge 30 at step S28, and then completes the process of FIG. 10. The controller 130 may notify a user that ink in the ink cartridge 30 has deteriorated, or that the replacement of the ink cartridge 30 is needed. How to notify a user is not limited to a specific way, but the controller 130 may have the display 109 display a message or have a speaker (not shown) of the printer 10 sound out an audio message.

Figure 11:
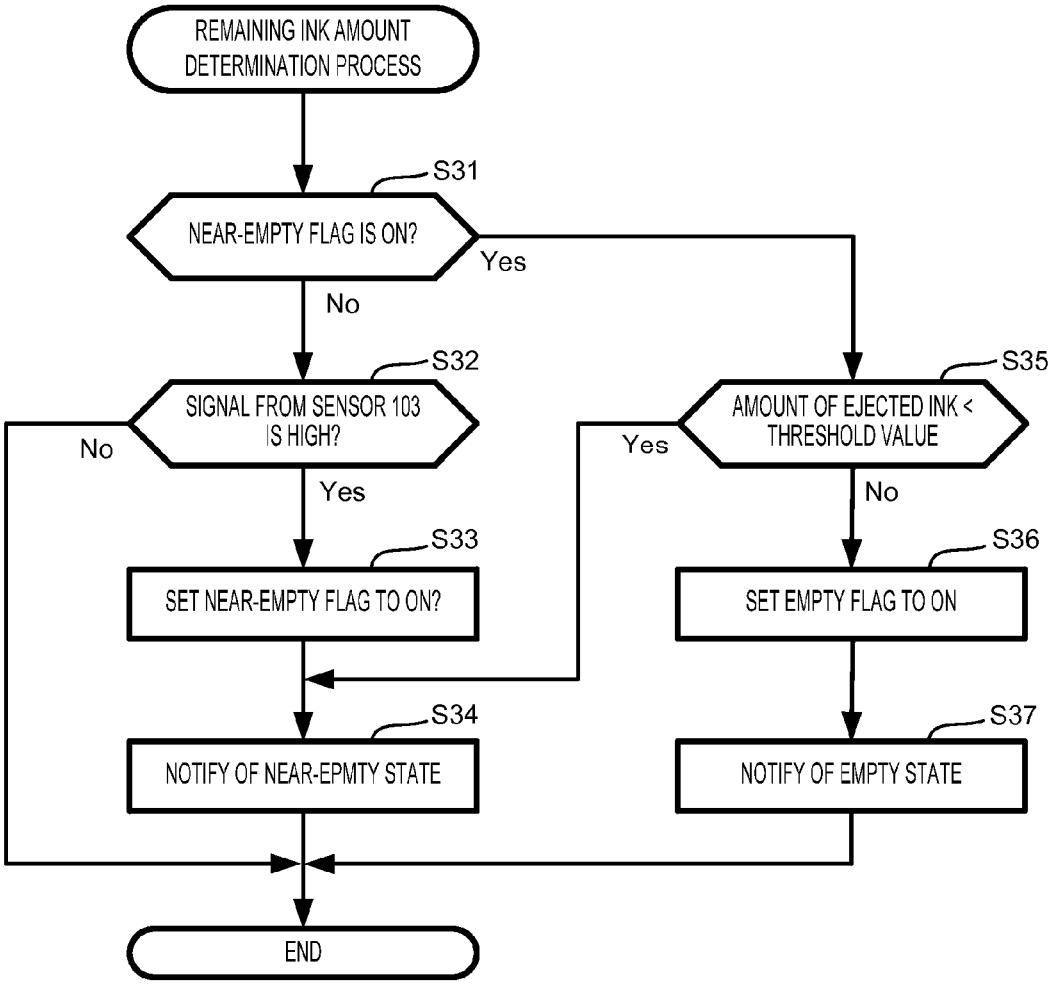
FIG. 11 is a flow chart of a remaining ink amount determination process performed by the controller.

If the error flag is set to "OFF" (step S22: No), the controller 130 performs a remaining ink amount determination process at step S23. Referring to FIG. 11, the remaining ink amount determination process is explained.

The controller 130 determines whether a near-empty flag is set to "ON" at step 31. The near-empty flag and an empty flag (described later) are set for each ink cartridge 30. The controller 130 sets each of the near-empty flag and the empty flag to "OFF" when the corresponding ink cartridge 30 is removed from the cartridge mounting portion 110, i.e., when the detection signal output from the mount sensor 107 changes from the High-level signal to the Low-level signal.

If the near-empty flag is set to "OFF" (step S31: No), the controller 130 determines whether the sensor 103 outputs the High-level signal at step S32. If the sensor 103 outputs the High-level signal (step S32: Yes), the controller 130 sets the near-empty flat to "ON" at step S33. Subsequently, the controller 130 notifies a user that the remaining ink amount in the ink cartridge 30 has become less than a threshold amount at step S34, and completes the processes of FIG. 11. How to notify a user is not limited to a specific way, but the controller 130 may have the display 109 display a message or have a speaker (not shown) of the printer 10 sound out an audio message.

The situation in which the sensor 103 outputs the High-level signal at step S32 corresponds to a situation in which the ink surface in the second ink chamber 36 lowers and the detection portion 93 moves out of the detection position. Therefore, there is still some amount of ink in the second ink chamber 36, but the amount is small.

After the controller 130 sets the near-empty flag to "ON" at step S33, the controller 130 counts an amount of ink ejected by the recording head 21 and stores the counted amount in the EEPROM 134 for each ink cartridge 30. When the ink cartridge 30 is removed from the cartridge mounting portion 110, the controller 130 clears the counted amount in the EEPROM.

If the sensor 103 outputs the Low-level signal (step S32: No), the controller 130 skips the processes of steps S33 and S34, and completes the processes of FIG. 11. The situation in which the sensor outputs the Low-level signal at step S32 corresponds to a situation in which the remaining ink amount in the second ink chamber 36 is sufficient, and the detection portion 93 is in the detection position.

If the near-empty flag is set to "ON" (step S31: Yes), the controller 130 compares the amount of ejected ink stored in the EEPROM 134 and a predetermined threshold value at step S35. If the amount of ejected ink is less than the threshold value (step S35: Yes), the controller 130 performs the process of step S34 and completes the processes of FIG. 11. If the amount of ejected ink is greater than or equal to the threshold value (step S35: No), the controller 130 sets the empty flag to "ON" at step S36. Subsequently, the controller 130 notifies a user that the ink cartridge 30 becomes empty at step S37, and completes the processes of FIG. 11. How to notify a user is not limited to a specific way, but the controller 130 may have the display 109 display a message or have a speaker (not shown) of the printer 10 sound out an audio message.

Referring back to FIG. 10, the controller 130 determines whether the empty flag is set to "ON" at step S24. If the empty flag is set to "ON" (step S24: Yes), the controller 130 completes the processes of FIG. 10. If the empty flag is set to "OFF" (step S24: No), the controller 130 determines whether it receives an image-recording instruction at step S25. If the controller 130 does not receive the image-recording instruction (step S25: No), the controller 130 completes the processes of FIG. 10. If the controller 130 receives the image-recording instruction (step S25: Yes), the controller 130 directly or indirectly controls the recording head 21, the paper feed roller 23, the conveying roller pair 25, the discharge roller pair 27, etc. to record an image on a sheet of recording paper at step S26, and then complete the processes of FIG. 10. The controller 130 may record an image on one sheet of recording paper when performing the process of step S26 once, or the controller 130 may record images corresponding to all the image date that the controller 130 received when performing the process of step S26 once.

If the error flag is set to "ON" (step S22: Yes), the controller 130 does not perform the process of step S26, i.e., the image-recording process. In other words, the controller 130 skips step S26 and thereby restricts the consumption of ink by the recording head 21.

According to the processes of FIG. 10, if an ink cartridge 30 having a sufficient amount of ink stored therein is removed from the cartridge mounting portion 110, and then is mounted to the cartridge mounting portion 110 again, the error flag is set to "ON." This is because ink no longer moves from the first ink chamber 35 to the second ink chamber 36 when the ink cartridge 30 is mounted to the cartridge mounting portion 110 again. In this situation, the image-recording process of step S26 is skipped even if the ink cartridge 30 has a sufficient amount of ink. Therefore, in another embodiment, the controller 130 may ask a user if he or she has replaced the ink cartridge 30 after step S22. How to ask a user is not limited to a specific way, but the controller 130 may have the display 109 display a message or have a speaker (not shown) sound out an audio message. The controller 130 then may wait for a signal to come from an input interface (not shown) of the printer 10. For instance, the input interface is an interface on which a user may give instructions to the printer 10 by pressing bottoms on it. If the controller 130 receives from the input interface a signal indicating that the ink cartridge 30 has not been replaced, the controller 130 may not perform the process of step S28 and perform the process of step S26. In such a case, the processes performed by the controller 130 may be different from the ones of FIGS. 9 and 10, but the description thereof is omitted here.

[Advantages]

According to the above-described embodiment, the flow rate of ink, i.e., an amount (volume) of ink per unit time, moving from the first ink chamber 35 to the second ink chamber 36 varies depending on the viscosity of ink. By measuring the transit time required for the ink flowing into the second ink chamber 36 to cause the detection portion 93 to reach the detection position, the viscosity of ink in the first ink chamber 35 and the second ink chamber 36 can be estimated, e.g. whether the viscosity of ink is within a certain range or not can be estimated. Therefore, the degree of deterioration of ink can be estimated by calculating the transit time even when the ink cartridge 30 has not been mounted to the printer 10 and been unused for a long time. Moreover, if a plurality of ink cartridges 30 storing inks having different viscosities are configured to be mounted to the same cartridge mounting portion 110, it is possible to determine which ink cartridge 30 is mounted by calculating the transit time.

According to the above-described embodiment, the second ink chamber 36 does not store ink before the ink cartridge 30 is mounted to the cartridge mounting portion 110. Therefore, the formation of air bubbles in the second ink chamber 36 can be prevented. The movement of the movable member 90 is not hindered by air bubbles adhering to the float 92 or the detection portion 93.

Moreover, air bubbles formed in the first ink chamber 35 tend to accumulate in an upper portion of the first ink chamber 35. Because a portion of the first ink chamber 35 and a portion of the second ink chamber 36 are positioned above the communication path, there is a reduced likelihood that the air bubbles accumulating in the upper portion of the first ink chamber 35 flows into the second ink chamber 36 through the communication path.

According to the above-described embodiment, both of the communication path, i.e., the opening 64, the ink supply chamber 61, and the opening 65, and the ink supply path, i.e., the opening 63, the first space of the ink supply chamber 61, the opening 78, the inner space of the inner cylindrical member 76, the opening 79, and the second space of the ink supply chamber 61, are formed in the ink supply portion 60. Moreover, the communication path and the ink supply path are opened and closed by the movement of the inner cylindrical member 76. Therefore, the structure of the ink cartridge 30 can be simple with reduced number of elements. Nevertheless, in another embodiment, the communication path and the ink supply path may be formed independently. Moreover, the communication path and the ink supply path may be opened and closed by a member different from the inner cylindrical member 76.

When the hollow tube 102 is removed from the ink supply chamber 61, the inner cylindrical member 76 moves from the second position back to the first position by the biasing force of the coil spring 82. Therefore, when the ink cartridge 30 is removed from the cartridge mounting portion 110, the communication path and the ink supply path are closed again, and ink leakage from the ink cartridge 30 can be reduced.

According to the above-described embodiment, when the transit time is out of the threshold range (step S8: No), the controller 130 restricts the performance of the recording head 29, i.e., skips step S26. Therefore, a trouble of the recording head 21 which may be caused by an unusual viscosity of ink can be prevented. Nevertheless, it is not always necessary to skip step S26. In another embodiment, if the error flag is "ON" (step S22: Yes), the process of step S28 notifying a user of the information about the ink cartridge 30 may be performed, but the controller 130 may let the user decide whether image recording should be performed. In such a case, the processes performed by the controller 130 may be different from the ones of FIGS. 9 and 10, but the description thereof is omitted here.

Moreover, in another embodiment, if the error flag is "ON" (step S22: Yes), steps S23 to S26 may not be skipped, but the controller 130 may control the head control board 21A, such that the driving voltages applied to the piezoelectric actuators 29A are adjusted at step S26. More specifically, the controller 130 outputs different control signals to the heard control board 21A, such that the driving voltages applied to the piezoelectric actuators 29A are adjusted for the amounts of ink ejected from the nozzles 29 to be the same amount between when the transit time is within the threshold range and when the transit time is out of the threshold range. That is, when the transit time is below the lower limit value of the threshold range (it is estimated that the viscosity of ink is too low), the driving voltages are made smaller than the driving voltages when the transit time is within the threshold range. When the transit time is above the upper limit value of the threshold range (it is estimated that the viscosity of ink is too high), the driving voltages are made larger than the driving voltages when the transit time is within the threshold range. In this case, if a plurality of ink cartridges 30 storing inks having different viscosities is configured to be mounted to the same cartridge mounting portion 110, it is possible to drive the piezoelectric actuators 29A with suitable voltages according to types of ink. The actuators may not be limited to the piezoelectric actuators 29A, but may be thermal-type actuators, which ejects ink from the nozzles 29 by applying heat to ink and thereby generating bubbles in ink.

In addition to controlling the head control board 21A, such that the driving voltages applied to the piezoelectric actuators 29A are adjusted, the controller 130 may control a purge operation, in which ink is forcedly discharged from the nozzles 29 of the recording head 21. For instance, if the controller 130 determines that the error flag is set to "ON" (step S22: Yes), the controller 130 may control the purge operation, such that ink is discharged with more pressure applied thereto than if the controller 130 determines that the error flag is set to "OFF" (step S22: No). More specifically, when ink is discharged from the nozzles 29 of the recording head 21 by a suction pump, the controller 130 may control the suction pump, such that the suction pump sucks ink with more suction pressure if the error flag is set to "ON." With this control, air bubbles or thickened ink in the recording head 21 can be reliably discharged by the purge operation even if the viscosity of ink is high, and ink can be reliably supplied from the ink tube 20 to the recording head 21.

In the above-described embodiment, both of the upper limit value and the lower limit value of the threshold range are specified. Nevertheless, in another embodiment, at least one of the upper limit value and the lower limit value of the threshold range is specified.

The viscosity of ink changes when the surrounding temperature changes. When the temperature is high, the viscosity is low. When the temperature is low, the viscosity is high. The controller 130 may control the head control board 21A, such that the driving voltages applied to the piezoelectric actuators 29A are adjusted based on the temperature. More specifically, when the temperature is high, the controller 130 outputs control signals to the head control board 21A, such that low driving voltages are applied to the piezoelectric actuators 29A. When the temperature is low, the controller 130 outputs control signals to the head control board 21A, such that high driving voltages are applied to the piezoelectric actuators 29A. There is an optimum threshold range of the viscosity of ink, corresponding to the driving voltages applied to the piezoelectric actuators 29A which are determined by the temperature. In other word, it is preferable to set the threshold range of the viscosity of ink based on the temperature. Therefore, according to the above-described embodiment, the controller 130 determines the threshold range based on the temperature at step S7. How to determine the threshold range is not limited to a specific way, but the controller 130 may select one suitable threshold range based on the temperature out of a plurality of threshold ranges stored in the ROM 132, or may calculate the upper limit value or the lower limit value of the threshold range as a function of the temperature value. Nevertheless, step S7 for determining the threshold range based on the temperature may be removed, and a fixed threshold range can be used at step S8, when, for example, the driving voltages applied to the piezoelectric actuators 29A are not adjusted based on the temperature.

According to the above-described embodiment, the controller 130 stores the error flag in the EEPROM 134, but the controller 130 may store the error flag in a memory of an IC chip (not shown) mounted on the ink cartridge 30. According to the above-described embodiment, the controller 130 comprises the CPU 131 and the ASIC 135, but the controller 130 may not comprise the ASIC 135 and the CPU 131 may perform all the processes of FIGS. 9 to 11 by reading out a program stored in the ROM 132. On the contrary, the controller 130 may not comprise the CPU 131, and may comprise hardware only, such as the ASIC 135 or FPGA. Moreover, the controller 130 may comprise a plurality of CPUs 131 and/or a plurality of ASICs 135.

Referring to FIGS. 12A to 16B, first to third modified embodiments are described. The descriptions of the parts which are common between the above-described embodiment and the first to third embodiments may be omitted, but the parts which are different from the parts of the other embodiments are described. Moreover, the parts of the above-described embodiment and the first to third modified embodiments can be arbitrarily combined as long as the object of the invention is achieved.

First Modified Embodiment

Figure 12A:
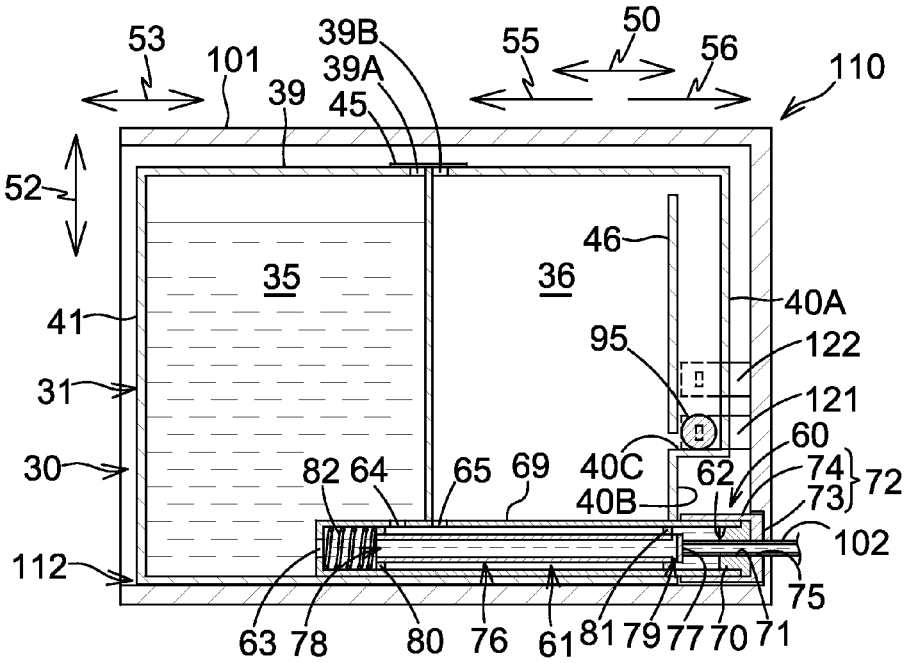
FIG. 12A is a cross-sectional view of an ink cartridge and a cartridge mounting portion according to a first modified embodiment when mounting of the ink cartridge to the cartridge mounting portion has been just completed.
Figure 12B:
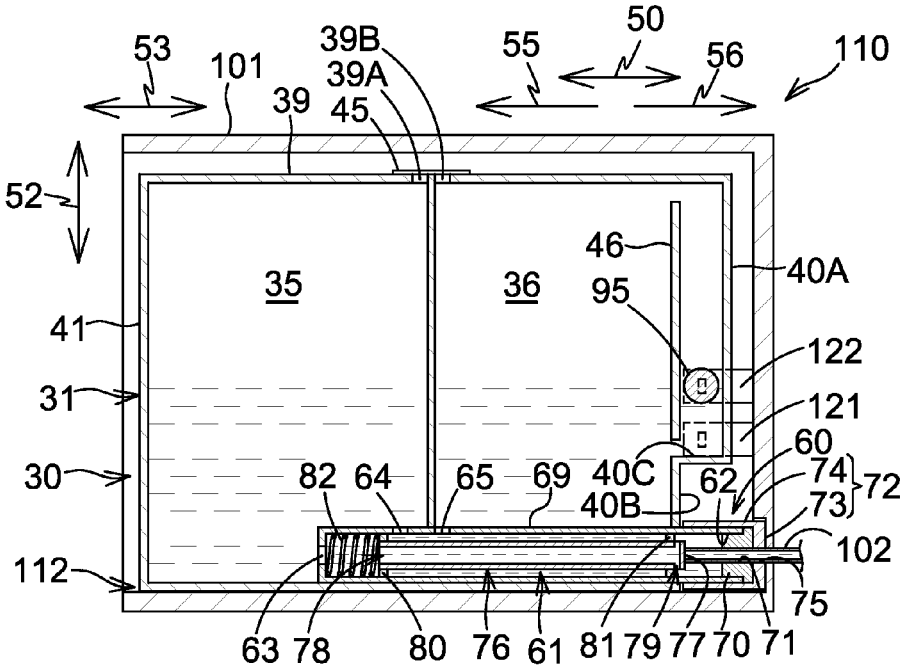
FIG. 12B is a cross-sectional view of the ink cartridge and the cartridge mounting portion according to the first modified embodiment when mounting of the ink cartridge to the cartridge mounting portion has been completed and a detection portion reaches a detection position.

Referring to FIGS. 12A and 12B, an ink cartridge 30 and a cartridge mounting portion 110 according to the first modified embodiment are described. The cartridge mounting portion 110 comprises a first sensor 121 and a second sensor 122 instead of the sensor 103 and the mount sensor 107. The first sensor 121 and the second sensor 122 are positioned away from each other in the height direction 52. The first sensor 121 and the second sensor 122 are positioned at the end surface of the cartridge mounting portion 110. Each of the first sensor 121 and the second sensor 122 has the same structure as the sensor 103. The ink cartridge 30 comprises a guide wall 46 and a movable member 95 in the second ink chamber 36 instead of the movable member 90.

The guide wall 46 extends from the inner surface of the right wall 38 to the left wall 37 (the film 44) in the width direction 51. The guide wall 46 also extends in the height direction 52 from a position adjacent to the connecting wall 40C to a position adjacent to the top wall 39. The guide wall 46 faces the first wall 40A of the front wall 40 in the depth direction 53 and extends substantially in parallel with the first wall 40A.

In this first modified embodiment, the movable member 95, the detection portion, the float, and the light blocking portion are one and the same member. That is, the movable member (detection portion, float, light blocking portion) 95 has a specific gravity which is less than the specific gravity of ink. Moreover, the movable member (detection portion, float, light blocking portion) 95 blocks lights emitted by the light blocking portions of the first sensor 121 and the second sensor 122, respectively. The movable member (detection portion, float, light blocking portion) 95 is positioned between the first wall 45A and the guide wall 46. The gap between the connecting wall 40C and the guide wall 46 and the gap between the top wall 39 and the connecting wall 40C is less than the movable member (detection portion, float, light blocking portion) 95.

Referring to FIG. 12A, before ink flows into the second ink chamber 36, the movable member (detection portion, float, light blocking portion) 95 is in a first detection position to be detected by the first sensor 121. That is, the movable member (detection portion, float, light blocking portion) 95 blocks the light of the first sensor 121 when positioned in the first detection position. Therefore, the first sensor 121 outputs the Low-level signal to the controller 130, and the second sensor 122 outputs the High-level signal to the controller 130. When the detection signal output from the first sensor 121 changes from the High-level signal to the Low-level signal, the controller 130 determines that the ink cartridge 30 is mounted to the cartridge mounting portion 110.

Referring to FIG. 12B, as the ink surface in the second ink chamber 36 moves up, the movable member (detection portion, float, light blocking portion) 95 moves up between the guide wall 40 and the first wall 40A. When the movable member (detection portion, float, light blocking portion) 95 moves out of the first detection position, the detection signal output from the first sensor 121 changes from the Low-level signal to the High-level signal. When the movable member (detection portion, float, light blocking portion) 95 reaches a second detection position where the movable member (detection portion, float, light blocking portion) 95 blocks the light of the second sensor 122, the detection signal output from the second sensor 122 changes from the High-level signal to the Low-level signal.

The controller 130 measures, as the transit time, a time from when the detection signal output from the first sensor 121 changes from the High-level signal to the Low-level signal to when the detection signal output from the second sensor 122 changes from the High-level signal to the Low-level signal. Alternatively, the controller 130 measures, as the transit time, a time from when the detection signal output from the first sensor 121 changes from the Low-level signal to the High-level signal to when the detection signal output from the second sensor 122 changes from the High-level signal to the Low-level signal.

As the ink surface in the second ink chamber 36 lowers, the movable member (detection portion, float, light blocking portion) 95 moves down between the guide wall 46 and the first wall 40A. When the movable member (detection portion, float, light blocking portion) 95 moves out of the second detection position, the detection signal output from the second sensor 122 changes from the Low-level signal to the High-level signal. When the movable member (detection portion, float, light blocking portion) 95 reaches the first detection position, the detection signal output from the first sensor 121 changes from the High-level signal to the Low-level signal. When the detection signal output from the first sensor 121 changes from the High-level signal to the Low-level signal after the controller 130 determines that the transit time is within the threshold range, the controller 130 sets the near-empty flag to "ON," and notify a user of the near-empty state.

In measuring the transit time, the first sensor 121 of this first modified embodiment functions as the mount sensor 107 of the above-described embodiment, and the second sensor 122 of this first modified embodiment functions as the sensor 103 of the above-described embodiment. On the other hand, in determining the remaining ink amount in the second ink chamber 36, the first sensor 121 of this first modified embodiment functions as the sensor 103 of the above-described embodiment. Nevertheless, there is a difference in that the controller 130 of this modified embodiment sets the near-empty flag to "ON" when the detection signal output from the first sensor 121 changes from the High-level signal to the Low-level signal, while the controller 130 of the above-described embodiment sets the near-empty flag to "ON" when the detection signal output from the sensor 103 changes from the Low-level signal to the High-level signal.

Second Modified Embodiment

Referring to FIGS. 13A to 15, an ink cartridge 30 and a cartridge mounting portion 110 according to a second modified embodiment are described. The capacity of the second ink chamber 36 is smaller than the capacity of the first ink chamber 35. Therefore, the ink surfaces in the first ink chamber 35 and the second ink chamber 36 after the first ink chamber 35 and the second ink chamber 36 are brought into communication are higher than those in the above-described embodiment and the first modified embodiment. Moreover, the movable member 90 of this second modified embodiment is positioned higher than the movable member 90 of the above-described embodiment. The sensor 103 is positioned at an upper portion of the cartridge mounting portion 110.

Figure 13A:
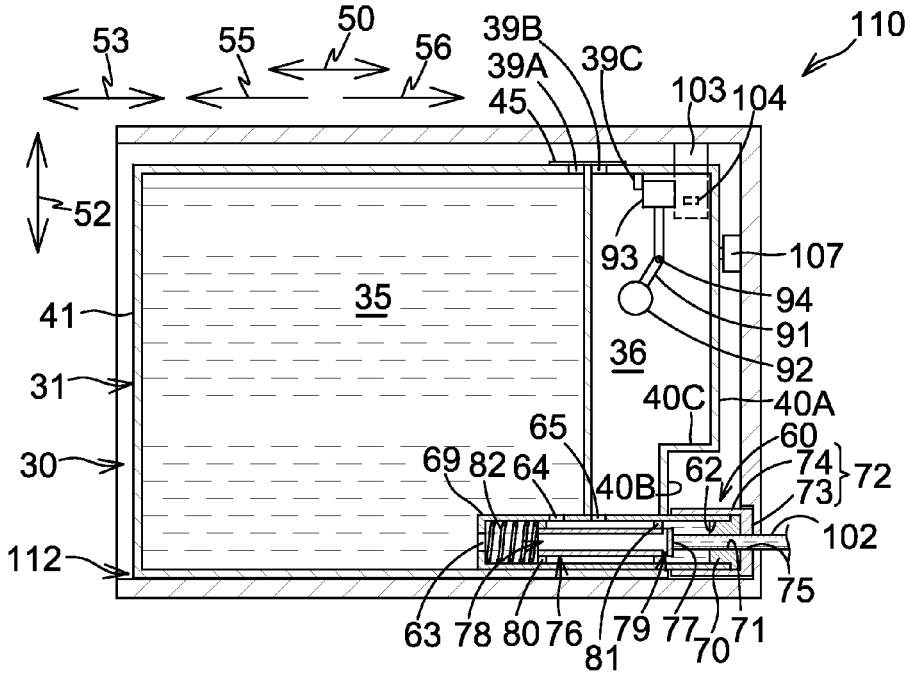
FIG. 13A is a cross-sectional view of an ink cartridge and a cartridge mounting portion according to a second modified embodiment when mounting of the ink cartridge to the cartridge mounting portion has been just completed.

The frame 31 comprises a contact portion 39C extending downward from the inner surface of the top wall 39. Referring to FIG. 13A, before ink flows into the second ink chamber 36, the detection portion 93 contacts the contact portion 39C, and the detection portion 93 is not in the detection position. The sensor 103 outputs the High-level signal.

Figure 13B:
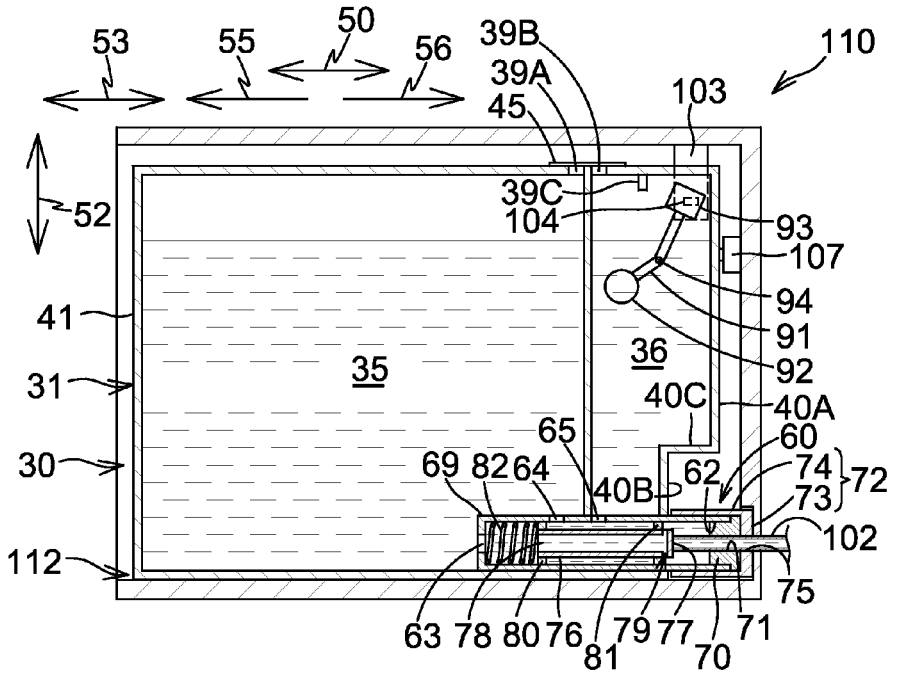
FIG. 13B is a cross-sectional view of the ink cartridge and the cartridge mounting portion according to the second modified embodiment when mounting of the ink cartridge to the cartridge mounting portion has been completed and a detection portion reaches a detection position.

Referring to FIG. 13B, as the ink surface in the second ink chamber 36 moves up, the float 92 moves up and the movable member 90 pivots in the first direction, i.e., in the clockwise direction in FIG. 13B. As a result, the detection portion 93 reaches the detection position, and the sensor 103 outputs the Low-level signal. Subsequently, when the ink surface ink the second ink chamber 36 moves down, the movable member 90 pivots in the second direction, i.e., in the counter-clockwise direction in FIG. 13B. The detection portion 93 moves out of the detection position, and the sensor outputs the High-level signal.

The controller 130 performs the processes of FIG. 9 based on the detection signals output from the sensor 103 and the mount sensor 107. The controller 130 performs the processes of FIGS. 14 and 15 instead of the processes of FIGS. 10 and 11. The processes which are common between FIG.

Figure 14:
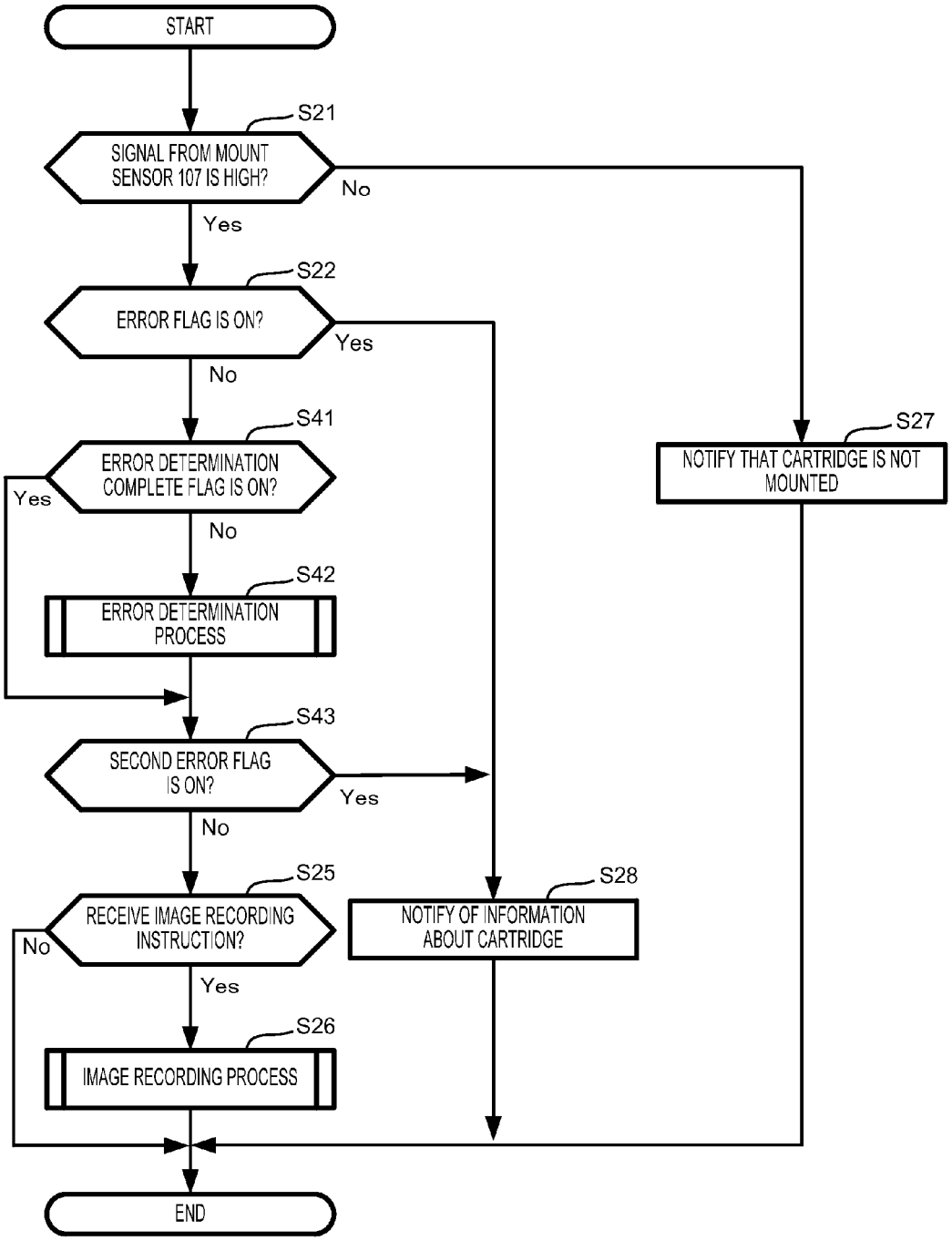
FIG. 14 is a flow chart of processes performed by the controller when the processes of FIG. 9 have been completed and the cover of the cartridge mounting portion is closed, according to the second modified embodiment.

10 and FIG. 14 are given the same step numbers and the descriptions thereof are omitted here.

The controller 130 performs steps S41 to 43 of FIG. 14 instead of steps S23 and S24 of FIG. 10. The controller 130 counts an amount of ink ejected by the recording head 21 for each ink cartridge 30 after the mounting of the ink cartridge 30 to the cartridge mounting portion 110 is completed.

If the error flag is set to "OFF" (step S22: No), the controller 130 determines whether the error determination complete flag is set to "ON" at step S41. The error determination complete flag and a second error flag (described later) are set for each ink cartridge 30. The controller 130 sets each of the error determination complete flag and the second error flag to "OFF" when the corresponding ink cartridge 30 is removed from the cartridge mounting portion 110, i.e., when the detection signal output from the mount sensor 107 changes from the High-level signal to the Low-level signal. If the error determination complete flag is set to "OFF" (step S41: No), the controller 130 performs an error determination process at step 42. The error determination process is performed for determining whether the amount of ink ejected by the recording head 21 appropriate.

Figure 15:
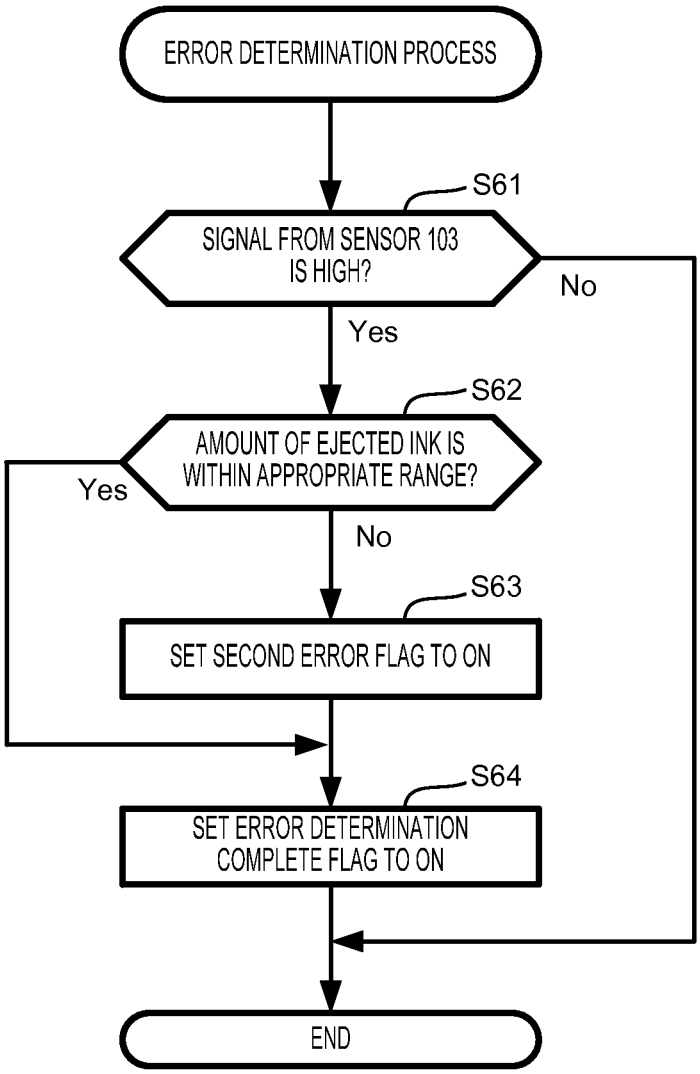
FIG. 15 is a flow chart of an error determination process performed by the controller, according to the second modified embodiment.

Referring to FIG. 15, the error determination process is explained. The controller 130 determines whether the sensor 103 outputs the High-level signal at step S61. If the sensor 103 outputs the High-level signal (step S61: Yes), the controller 130 compares the amount of ejected ink by the recording head 21 with a predetermined appropriate range at step S62. If the amount of ejected ink is out of the appropriate range (step S62: NO), the controller 130 sets the second error flag to "ON" at step S63. Subsequently, the controller 130 sets the error determination complete flag to "ON" at step S64 and complete the processes of FIG. 15.

If the amount of ejected ink is within the appropriate range (step S62: Yes), the controller 130 skips the process of step S63 and performs the process of step S64. If the sensor 103 outputs the Low-level signal, (step S61: No), the controller 130 skips the processes of steps S62 to S64, and complete the processes of FIG. 15.

Referring back to FIG. 14, the controller 130 determines whether the second error flag is set to "ON" at step S43. If the second error flag is set to "ON" (step S43: Yes), the controller 130 performs the process of step S28. If the second error flag is set to "OFF" (step S43: No), the controller 130 performs the process of step S25.

According to the second modified embodiment, if the amount of ejected ink counted, i.e., estimated by the controller 130 is largely different from the actual reduced amount of ink in the second ink chamber 36, a user can be notified of such an error. For instance, if the amount of ejected ink counted, i.e., estimated by the controller 130 is greater than the appropriate range, the viscosity of ink may be too high, or an ink path extending from the ink cartridge 30 to the recording head 21 has an unusually high flow resistance. On the other hand, if the amount of ejected ink counted, i.e., estimated by the controller 130 is less than the appropriate range, the viscosity of ink may be too low, or ink may leak from the ink path extending from the ink cartridge 30 to the recording head 21. Because the movable member 90 is positioned at an upper portion of the second ink chamber 36, the sensor 103 outputs the High-level signal at step S61 at an early timing after the mounting of the ink cartridge 30 to the cartridge mounting portion 110 is completed. Therefore, the error can be detected early and a fatal damage to the printer 10 may be avoided.

Third Modified Embodiment

Figure 16A:
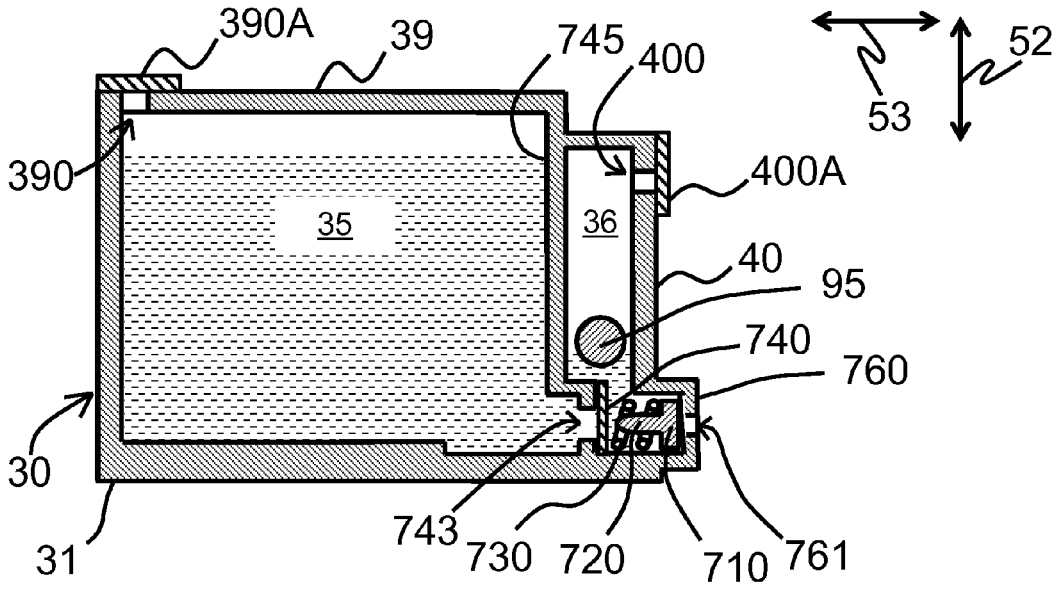
FIG. 16A is a cross-sectional view of an ink cartridge according to a third modified embodiment, in which a pointed member is in a standby position.
Figure 16B:
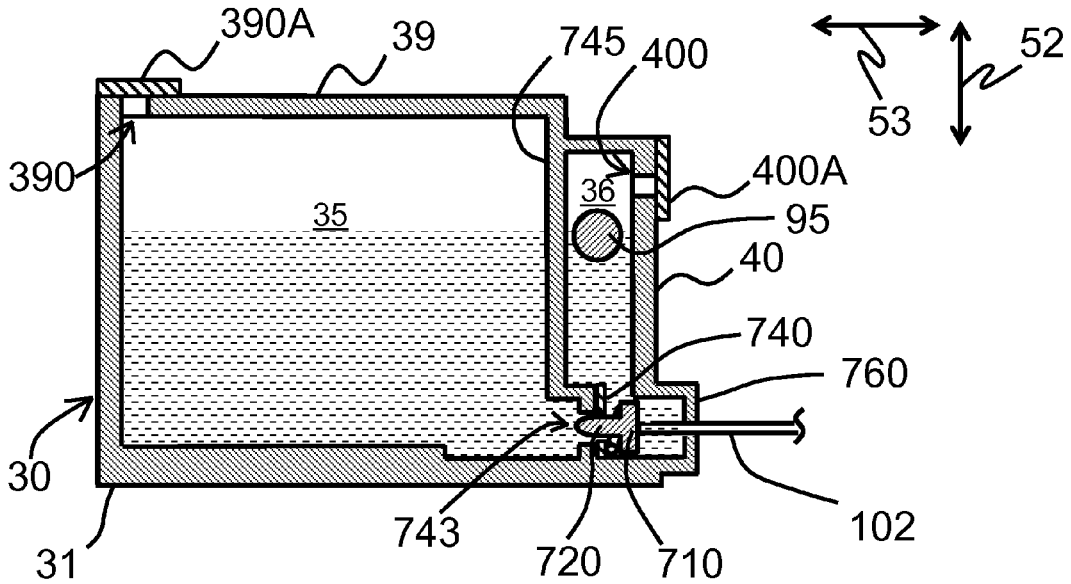
FIG. 16B is a cross-sectional view of the ink cartridge according to the third modified embodiment, in which the pointed member is in a rupture position.

Referring to FIGS. 16A and 16B, an ink cartridge 30 according to the third modified embodiment is described. The frame 31 comprises a partitioning wall 745 instead of the partitioning wall 43. The partitioning wall 745 has an opening 743 formed therethrough in the depth direction 53. The opening 743 functions as a communication path. The ink cartridge 30 comprises an ink supply portion 760 instead of the ink supply portion 60. The frame has an opening 400 and an opening 390 instead of the opening 39A and the opening 39B. The ink cartridge 30 comprises an air permeable film 390A and an air permeable film 400A instead of the air permeable film 45.

The ink supply portion 760 extends from the front outer face of the front wall 40 in the insertion direction 56. The ink supply portion 760 has a cylindrical shape. The ink supply portion 760 has a proximal end at the front wall 40 and a distal end opposite the proximal end. The ink supply portion 760 has a liquid supply opening, e.g., an ink supply opening 761 formed at the distal end. The ink supply opening 761 extends in the depth direction 53. The ink supply portion 760 has an inner space and the inner space can be in fluid communication with the exterior of the ink cartridge 30 via the ink supply opening 761. The inner space of the ink supply portion 760 is in fluid communication with the inner space of the frame 31, i.e., the second ink chamber 36, at the proximal-end side. The second ink chamber 36 can be in fluid communication with the exterior of the ink cartridge 30 via the ink supply portion 760.

The ink cartridge 30 comprises a valve member 710 which is movable between a close position as shown in FIG. 16A and an open position as shown in FIG. 16B in the depth direction 53. When the valve member 710 is in the close position, the valve member 710 contacts a wall surrounding the ink supply opening 761 and thereby closes the ink supply opening 761. When the valve member 710 is in the open position, the valve member 710 is positioned away from the wall surrounding the ink supply opening 761 and thereby opens the ink supply opening 761.

The ink cartridge 30 comprises a blocking member, e.g., a rupturable wall, e.g., a film 740 attached to the wall surrounding the opening 743 to close the opening 743. The ink supply opening 761 extends in the depth direction 53, and the ink supply opening 761 and the film 740 are aligned in the depth direction 53. The ink cartridge 30 comprises a biasing member, e.g., a coil spring 730 positioned between the wall surrounding the opening 743 and the valve member 710. The coil spring 730 biases the valve member 710 into the close position. The film 740 has a thickness in the depth direction 53, and the partitioning wall 745 has a thickness in the depth direction 53, and the thickness of the film 740 is less than the thickness of the partitioning wall 745.

The ink cartridge 30 comprises a pointed member 720 extending from the valve member 710 toward the film 740. The pointed member 720 is movable between a standby position as shown in FIG. 16A and a rupture position as shown in FIG. 16B. When the pointed member 720 moves from the standby position to the rupture position, the pointed member 720 penetrates and ruptures the film 740 so as to open the opening 743. When the valve member 710 is in the close position, the pointed member 720 is in the standby position. When the valve member 710 is in the open position, the pointed member 720 is in the rupture position.

The front wall 40 of the ink cartridge 30 has an opening 400 formed therethrough in the depth direction 53. The opening 400 is positioned closer to the upper end of the front wall 40 than to the lower end of the front wall 40. The ink cartridge 30 comprises an air permeable film 400A attached to the front outer face of the front wall 40 to cover the opening 400. The second ink chamber 36 is in air communication with the atmosphere outside the ink cartridge 30 via the opening 400 and the air permeable film 400A.

The top wall 39 of the ink cartridge 30 has an opening 390 formed therethrough in the height direction 52. The ink cartridge 30 comprises an air permeable film 390A attached to the top outer face of the top wall 39 to cover the opening 390. The first ink chamber 35 is in air communication with the atmosphere outside the ink cartridge 30 via the opening 390 and the air permeable film 390A.

The ink cartridge 30 comprises the same movable member (detection portion, float, light blocking portion) 95 as in the first modified embodiment.

Referring to FIG. 16B, when the hollow tube 102 is inserted through the ink supply opening 761, the hollow tube 102 contacts the valve member 710 and pushes the valve member 710 and the pointed member 720. When this occurs, the valve member 710 moves from the close position to the open position, and at the same time the pointed member 720 moves from the standby position to the rupture position. Ink flows from the first ink chamber 35 into the second ink chamber 36 through the opening 743 and flows into the hollow tube 102.

In this third modified embodiment, referring to FIG. 16A, before the ink cartridge 30 is mounted to the cartridge mounting portion 110, i.e., when the movable member 710 is in the block position, the second initial amount of ink in the second ink chamber 36 is not zero, and the first initial ink surface of the first initial amount of ink in the first ink chamber 35 is positioned above the second initial ink surface of the second initial amount of ink in the second ink chamber 36. Nevertheless, in another embodiment, the second initial amount may be zero. The ink surface in the first ink chamber 35 moves down and the ink surface in the second ink chamber 36 moves up as ink moves from the first ink chamber 35 to the second ink chamber 36 through the opening 743. The movable member (detection portion, float, light blocking portion) 95 moves up accordingly. Finally the height of the ink surface in the first ink chamber 35 and the height of the ink surface in the second ink chamber 36 becomes the same as shown in the FIG. 16B, and the movable member (detection portion, float, light blocking portion) 95 reaches the detection position.

The communication path, i.e., the opening 743 is positioned in a lower half portion of the ink cartridge 30. A portion of the first ink chamber 35 and a portion of the second ink chamber 36 are positioned in an upper half portion of the ink cartridge 30. Therefore, the portion of the first ink chamber 35 and the portion of the second ink chamber 36 are positioned above the communication path, i.e., the opening 743.

In the above-described embodiment and the first to third modified embodiments, ink is an example of liquid. Nevertheless, liquid is not limited to ink. For instance, liquid can be pre-treatment liquid which is ejected onto the sheet of paper before ink is ejected in printing.

In the above-described embodiment and the first to third modified embodiment, the ink cartridge 30 is manually mounted to the cartridge mounting portion 110. Nevertheless, how to mount the ink cartridge 30 to the cartridge mounting portion 110 is not limited to the manual mounting. An auto-loading mechanism can be provided to the cartridge mounting portion 110. For instance, with the auto-loading mechanism, a user has only to insert the ink cartridge 30 halfway into the cartridge mounting portion 110. Afterwards, the ink cartridge 30 is automatically moved in the insertion direction 56, and finally the mounting of the ink cartridge 30 to the cartridge mounting portion 110 is completed. Therefore, there is a reduced likelihood that the sensor 103 cannot detect the detection portion even if the first ink chamber 35 and the second ink chamber 36 are brought into fluid communication with each other.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. A liquid cartridge comprising:

a liquid chamber configured to store liquid therein, wherein the liquid has a first specific gravity;

a liquid supply portion configured to supply the liquid from an interior of the liquid chamber to an exterior of the liquid chamber;

a partitioning wall partitioning the liquid chamber into a first liquid chamber and a second liquid chamber, a communication path through which the liquid can flow from the first liquid chamber to the second liquid chamber;

a blocking member configured to block communication between the first liquid chamber and the second liquid chamber through the communication path, such that the liquid is prevented from flowing from the first liquid chamber to the second liquid chamber through the communication path; and a first movable member positioned in the second liquid chamber and comprising a detection portion and a float, wherein the float has a second specific gravity which is less than the first specific gravity such that the float moves in response to an amount of liquid in the second liquid chamber.

2. The liquid cartridge of claim 1, wherein the blocking member is a second movable member which is movable between a block position and a communication position, wherein when the second movable member is in the block position, the second movable member is configured to prevent the liquid from flowing from the first liquid chamber to the second liquid chamber through the communication path, and when the second movable member is in the communication position, the liquid is allowed to flow from the first liquid chamber to the second liquid chamber through the communication path.

3. The liquid cartridge of claim 2, wherein the liquid supply portion has a liquid supply opening extending in a first direction, wherein the liquid supply opening and the second movable member are aligned in the first direction.

4. The liquid cartridge of claim 2, further comprising a valve member which is movable between a close position and an open position, wherein the liquid supply portion has a liquid supply opening, wherein when the valve member is in the close position, the valve member is configured to close the liquid supply opening, and when the valve member is in the open position, the valve member is configured to open the liquid supply opening, wherein when the valve member is in the close position, the second movable member is in the block position, and when the second movable member is in the open position, the second movable member is in the communication position.

5. The liquid cartridge of claim 4, wherein the second movable member is connected to the valve member.

6. The liquid cartridge of claim 2, wherein the liquid chamber is positioned between a first outer face and a second outer face, the liquid supply portion being positioned at the first outer face, and wherein the communication position is closer to the second outer face than the block position is.

7. The liquid cartridge of claim 2, wherein when the second movable member is initially in the block position, the first liquid chamber stores the liquid therein and the second liquid chamber does not store the liquid therein.

8. The liquid cartridge of claim 2, wherein when the second movable member is initially in the block position, the first liquid chamber has a first initial amount of the liquid having a first initial liquid surface and the second liquid chamber has a second initial amount of the liquid having a second initial liquid surface, wherein the first initial liquid surface is positioned above the second initial liquid surface.

9. The liquid cartridge of claim 2, wherein the first movable member is configured to pivot about a pivot axis in the second liquid chamber, and the detection portion comprises a light blocking portion.

10. The liquid cartridge of claim 1, wherein the partitioning wall has a first thickness, and the blocking member is a rupturable wall closing the communication path, wherein the rupturable wall has a second thickness which is less than the first thickness.

11. The liquid cartridge of claim 10, wherein the liquid supply portion has a liquid supply opening extending in a first direction, wherein the liquid supply opening and the rupturable wall are aligned in the first direction.

12. The liquid cartridge of claim 11, further comprising a pointed member which is movable between a standby position and a rupture position, wherein the pointed member is configured to penetrate and rupture the rupturable wall so as to open the communication path when the pointed member moves from the standby position to the rupture position.

13. The liquid cartridge of claim 12, further comprising a valve member which is movable between a close position and an open position, wherein the liquid supply portion has a liquid supply opening, wherein when the valve member is in the close position, the valve member is configured to close the liquid supply opening, and when the valve member is in the open position, the valve member is configured to open the liquid supply opening, wherein when the valve member is in the close position, the pointed member is in the standby position, and when the valve member is in the open position, the pointed member is in the rupture position.

14. The liquid cartridge of claim 13, wherein the pointed member is connected to the valve member.

15. The liquid cartridge of claim 10, wherein the first liquid chamber stores the liquid therein and the second liquid chamber does not store the liquid therein.

16. The liquid cartridge of claim 10, wherein the first liquid chamber has a first initial amount of the liquid having a first initial liquid surface and the second liquid chamber has a second initial amount of the liquid having a second initial liquid surface, wherein the first initial liquid surface is positioned above the second initial liquid surface.

17. The liquid cartridge of claim 1, wherein a portion of the first liquid chamber and a portion of the second liquid chamber are positioned above the communication path.

18. The liquid cartridge of claim 17, wherein the communication path is positioned in a lower half portion of the liquid cartridge, and the portion of the first liquid chamber and the portion of the second liquid chamber are positioned in an upper half portion of the liquid cartridge.

19. A liquid cartridge comprising:

a first liquid chamber;

a second liquid chamber;

a first liquid supply passage in selective liquid communication between the first liquid chamber and the second liquid chamber including a communication path through which the liquid can flow from the first liquid chamber to the second liquid chamber, and a blocking member configured to block communication between the first liquid chamber and the second liquid chamber through the communication path, such that the liquid is prevented from flowing from the first liquid chamber to the second liquid chamber through the communication path;

a second liquid supply passage in selective liquid communication between the first liquid supply passage and an exterior of the liquid cartridge;

a movable member situated in the second liquid chamber and configured to move in response to an amount of liquid in the second liquid chamber.

20. The liquid cartridge of claim 19, further comprising:

a valve member having a close position in which the second liquid supply passage is closed to prevent liquid communication between the first liquid supply passage and the exterior of the liquid cartridge, and an open position in which the second liquid supply passage is open to establish the liquid communication between the first liquid supply passage and the exterior of the liquid cartridge.

21. The liquid cartridge of claim 19, wherein the blocking member has a block position in which the first liquid supply passage is blocked to prevent liquid communication between the first liquid chamber and the second liquid chamber, and a communication position in which the first liquid supply passage is open to establish the liquid communication between the first liquid chamber and the second liquid chamber.

22. The liquid cartridge of claim 21, further comprising a liquid supply portion that defines the second liquid supply passage, the liquid supply portion including:

a first opening between the first liquid chamber and the second liquid supply passage;

a second opening between the second liquid chamber and the second liquid supply passage;

wherein when the blocking member is in the block position liquid communication between the first opening and the second opening is blocked, and when the blocking member is in the communication position liquid communication between the first opening and the second opening is established.

23. The liquid cartridge of claim 22, wherein the liquid supply portion further includes a third opening between the first liquid supply passage and the second liquid supply passage.

24. The liquid cartridge of claim 21, wherein the blocking member defines a third liquid supply passage in liquid communication with the first liquid chamber and in selective liquid communication with the second liquid supply passage.

* * * * *